US010507655B2

(12) United States Patent
Okui et al.

(10) Patent No.: US 10,507,655 B2
(45) Date of Patent: Dec. 17, 2019

(54) LIQUID EJECTING HEAD, MANUFACTURING METHOD THEREOF, AND LIQUID EJECTING APPARATUS

(71) Applicant: SEIKO EPSON CORPORATION, Tokyo (JP)

(72) Inventors: Hiroaki Okui, Azumino (JP); Taiki Hanagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 15/950,437

(22) Filed: Apr. 11, 2018

(65) Prior Publication Data

US 2018/0297362 A1 Oct. 18, 2018

(30) Foreign Application Priority Data

Apr. 13, 2017 (JP) ..... 2017-079504
Jan. 25, 2018 (JP) ..... 2018-010292

(51) Int. Cl.

*B41J 2/14* (2006.01)
*B41J 2/045* (2006.01)
*B41J 2/155* (2006.01)
*B41J 2/16* (2006.01)

(52) U.S. Cl.

CPC ..... *B41J 2/14201* (2013.01); *B41J 2/045* (2013.01); *B41J 2/14233* (2013.01); *B41J 2/155* (2013.01); *B41J 2/161* (2013.01); *B41J 2/1607* (2013.01); *B41J 2/1623* (2013.01); *B41J 2002/14241* (2013.01); *B41J 2002/14362* (2013.01); *B41J 2002/14419* (2013.01); *B41J 2002/14491* (2013.01); *B41J 2202/19* (2013.01);

(Continued)

(58) Field of Classification Search

CPC .... B41J 2/14201; B41J 2/1607; B41J 2/1623; B41J 2/155; B41J 2/045; B41J 2202/22; B41J 2202/21; B41J 2/14233; B41J 2/161; B41J 2002/14362; B41J 2202/20; B41J 2202/19; B41J 2002/14491; B41J 2002/14419; B41J 2002/14241

USPC ..... 347/40

See application file for complete search history.

(56) References Cited

U.S. PATENT DOCUMENTS 4,954,839 A * 9/1990 Rogers ..... B41J 2/345 347/208
6,305,786 B1 * 10/2001 Plotkin ..... B41J 25/34 347/50

(Continued)

FOREIGN PATENT DOCUMENTS

JP 04361079 A * 12/1992
JP 2012-187726 A 10/2012

(Continued)

*Primary Examiner* — Stephen D Meier
*Assistant Examiner* — Alexander D Shenderov
(74) *Attorney, Agent, or Firm* — Workman Nydegger

(57) ABSTRACT

There are provided a conductive base; a plurality of head main bodies which are held by the base and each have a switching element and a pressure generating element for discharging a liquid in a pressure generating chamber; a plurality of covers which are separated from the base, at least one of the pressure generating element and the switching element being sandwiched between the base and each of the covers; and a plurality of conduction portions which each conduct the base and the cover to each other at a plurality of locations.

20 Claims, 11 Drawing Sheets

(52) U.S. Cl.
CPC ..... *B41J 2202/20* (2013.01); *B41J 2202/21* (2013.01); *B41J 2202/22* (2013.01)

(56) References Cited

U.S. PATENT DOCUMENTS

| | | | | |
|---|---|---|---|---|
| 7,585,046 | B2 * | 9/2009 | Miyata | B41J 2/145 347/17 |
| 2002/0196315 | A1 * | 12/2002 | Isono | B41J 2/14209 347/71 |
| 2010/0053265 | A1 * | 3/2010 | Kim | B41J 2/14024 347/40 |
| 2012/0229561 | A1 | 9/2012 | Ishii et al. | |
| 2014/0132677 | A1 * | 5/2014 | Kondo | B41J 2/14233 347/81 |
| 2015/0158303 | A1 | 6/2015 | Togashi | |

FOREIGN PATENT DOCUMENTS

| | | | |
|---|---|---|---|
| JP | 2012200962 | A | * 10/2012 |
| JP | 2015-112742 | A | 6/2015 |
| JP | 2015-217516 | A | 12/2015 |
| JP | 2017-144564 | A | 8/2017 |

* cited by examiner

LIQUID EJECTING HEAD, MANUFACTURING METHOD THEREOF, AND LIQUID EJECTING APPARATUS

BACKGROUND

1. Technical Field

The present invention relates to a liquid ejecting head which discharges a liquid from a nozzle, a manufacturing method thereof, and a liquid ejecting apparatus, particularly to an ink jet type recording head which discharges ink as a liquid, a manufacturing method thereof, and an ink jet type recording apparatus.

2. Related Art

A liquid ejecting apparatus represented by an ink jet type recording apparatus, such as an ink jet type printer or plotter, includes a liquid ejecting head that is capable of ejecting a liquid, such as ink stored in a cartridge, a tank or the like.

The liquid ejecting head includes a head main body which is provided with a nozzle opening for ejecting a liquid and a pressure generating element for generating a pressure change in a flow path that communicates with the nozzle opening, and a cover formed of a conductive material.

Since the cover is made of a conductive material, it is necessary to ground the cover such that the driving circuit having the pressure generating element or a switching element is not destroyed due to static electricity from the recording medium such as a paper sheet or a recording sheet (for example, refer to JP-A-2012-187726).

Meanwhile, when the cover is not sufficiently grounded, the cover functions as a planar antenna, and there is a problem that noise generated from the switching element for driving the pressure generating element or the switching element for driving the pressure generating element is emitted from the cover. In particular, in a case of a cover having a relatively large area, the ground tends to be inadequate and the cover easily functions as a planar antenna. In addition, in a case where a plurality of covers are arranged in parallel, there is a problem that amplification and directivity occur and deteriorate by making the cover into an antenna.

In addition, such a problem is not limited to the ink jet type recording head, and also exists in a liquid ejecting head that ejects the liquid other than ink.

SUMMARY

An advantage of some aspects of the invention is to provide a liquid ejecting head, a manufacturing method thereof, and a liquid ejecting apparatus which suppresses noise emission from the cover.

According to an aspect of the invention, there is provided a liquid ejecting head including: a conductive base; a plurality of head main bodies which are held by the base and each have a switching element and a pressure generating element for discharging a liquid in a pressure generating chamber; a plurality of covers which are conductive covers separated from the base, at least one of the pressure generating element and the switching element being sandwiched between the base and each of the covers; and a plurality of conduction portions which each conduct the base and the cover to each other at a plurality of locations.

In this case, as the cover which sandwiches at least one of the switching element and the pressure generating element with the base is conducted to the base with the plurality of conduction portions, the cover can be grounded in the plurality of conduction portions. Therefore, the cover functions as an antenna, and it is possible to suppress the noise from the inside of the liquid ejecting head from being emitted to the outside by the cover. In addition, by conducting the cover and the base to each other at the conduction portion and grounding the cover and the base, it is possible to protect at least one of the switching element and the pressure generating element sandwiched between the cover and the base from noise from the outside, and to suppress malfunction.

In the liquid ejecting head, it is preferable that the plurality of head main bodies be arranged in an in-plane direction of a nozzle surface which ejects a liquid of the head main body, the plurality of conduction portions be arranged in the in-plane direction of the nozzle surface which ejects the liquid of the head main body, and a direction in which the plurality of head main bodies are arranged and a direction in which the plurality of conduction portions are arranged intersect with each other. According to this, as the direction in which the plurality of head main bodies are arranged and the direction in which the plurality of conduction portions are arranged intersect with each other, it is possible to arrange the plurality of head main bodies at a high density, and to provide a plurality of conduction portions with respect to one head main body.

In the liquid ejecting head, it is preferable that, in the in-plane direction of the nozzle surface which ejects the liquid of the head main body, each of the plurality of conduction portions be at a position of sandwiching at least one of the pressure generating element and the switching element, and, in the direction orthogonal to the in-plane direction of the nozzle surface which ejects the liquid of the head main body, the plurality of conduction portions be positioned on the same side with respect to the cover. According to this, since at least one of the pressure generating element and the switching element sandwiched in the plurality of conduction portions is surrounded by a member which continuously conducts the base, the cover, and the conduction portion, it is possible to suppress the noise generated by at least one of the pressure generating element and the switching element which are surrounded by the member from being emitted to the outside, and to suppress the influence of noise from the outside. In addition, since the plurality of conduction portions are positioned on the same side with respect to the cover in the direction orthogonal to the in-plane direction of the nozzle surface of the head main body, it is possible to suppress unbalance of the stress with which the plurality of conduction portions abut against the cover, and to suppress displacement of the cover and the head main body.

In the liquid ejecting head, it is preferable that the cover have a liquid repellent surface, and the conduction portion be in contact with the cover on a surface opposite to the liquid repellent surface of the cover. According to this, even when an insulating material is used as the liquid repellent film which forms the liquid repellent surface, it is possible to conduct the cover and the conduction portion to each other. Therefore, the invention is not limited to the material of the liquid repellent film which forms the liquid repellent surface, and a material having high liquid repellency can be selected.

In the liquid ejecting head, it is preferable that a plurality of circuit boards which are each connected to the head main body and are for each grounding the cover, be provided, the plurality of conduction portions be arranged in the in-plane direction of the nozzle surface which ejects the liquid of the head main body, a plurality of the circuit boards be arranged in the in-plane direction of the nozzle surface which ejects the liquid of the head main body, and the direction in which the plurality of conduction portions are arranged and the direction in which the plurality of circuit boards are arranged be along each other. According to this, the cover can be grounded via the conduction portion by the circuit board, and the distance between the conduction portion and the circuit board can be shortened to ensure the grounding.

In the liquid ejecting head, it is preferable that each of the conduction portions include a gap conduction portion which conducts the covers adjacent to each other among the plurality of covers. According to this, grounding of the plurality of covers can be increased by the gap conduction portion, and grounding failure can be suppressed. In addition, by conducting the covers which are arranged in parallel to each other, the covers which are arranged in parallel can further suppress the generation of the amplification and directivity similar to a loop antenna.

In the liquid ejecting head, it is preferable the gap conduction portion be a porous metal. According to this, by using the gap conduction portion made of a porous metal, even when the liquid adheres to the gap conduction portion, the liquid is likely to tension the meniscus, and it is possible to hold the liquid in the gap between the covers adjacent to each other, and to suppress the liquid from falling at an unexpected timing.

In the liquid ejecting head, it is preferable that the gap conduction portion block a gap between the covers adjacent to each other. According to this, it is possible to suppress the liquid from entering the gap of the covers adjacent to each other by the gap conduction portion.

In the liquid ejecting head, it is preferable that the gap conduction portion be provided to be attachable and detachable to and from at least one of the covers adjacent to each other. According to this, it is possible to easily attach and detach the covers adjacent to each other, and to easily position the nozzle openings of the head main body provided with the cover as a reference.

In the liquid ejecting head, it is preferable that the head main body include a plurality of head chips each having a flow path of the liquid to be discharged from the nozzle surface of the head main body. According to this, the nozzle openings can be disposed at a high density, and the yield can be improved.

According to another aspect of the invention, there is provided a liquid ejecting apparatus including:

the liquid ejecting head according to the above-described aspect.

In the aspect, it is possible to realize a liquid ejecting apparatus in which malfunction caused by noise emission or noise from the outside is suppressed.

According to still another aspect of the invention, there is provided a manufacturing method of a liquid ejecting head including a plurality of head main bodies which each discharge a liquid in a pressure generating chamber by a switching element and a pressure generating element, a plurality of conductive covers, and a base which is separated from the covers, the method including: specifying the number of the covers provided in the base; changing the number of conduction portions to be provided which each conduct the base and each of the covers to each other based on the number of the covers specified in the specifying; and providing the conduction portions by each fixing each of the plurality of head main bodies and each of the plurality of covers to the base.

In this case, the optimum number of conduction portions is selected based on the number of covers provided in the base, and the liquid ejecting head can be manufactured.

In the manufacturing method of a liquid ejecting head, it is preferable that the number of the conduction portions be greater than the number of the covers. According to this, it is possible to suppress antenna formation due to the grounding failure of the cover.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
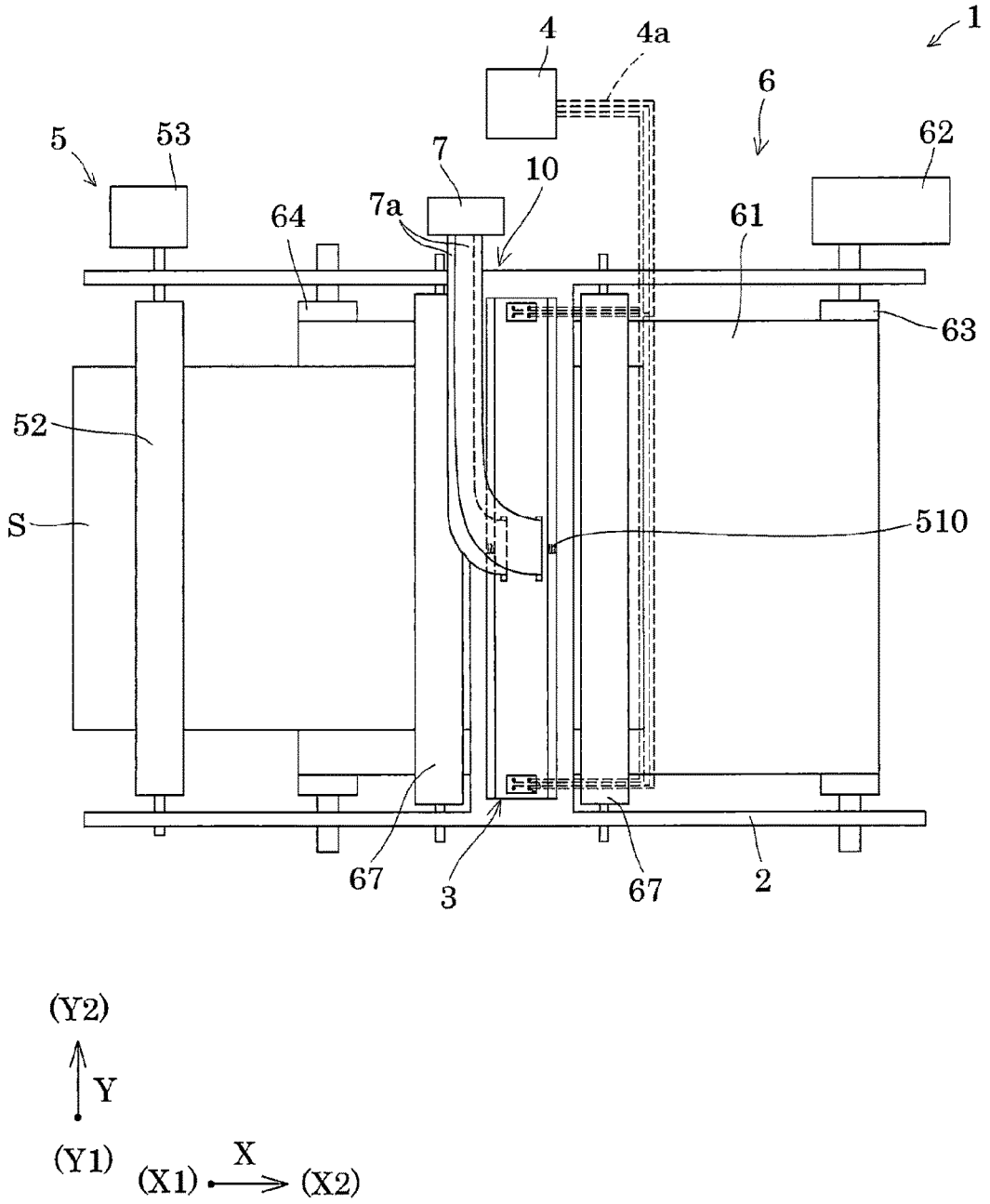
FIG. 1 is a top view illustrating a schematic configuration of a recording apparatus according to Embodiment 1 of the invention.
Figure 2:
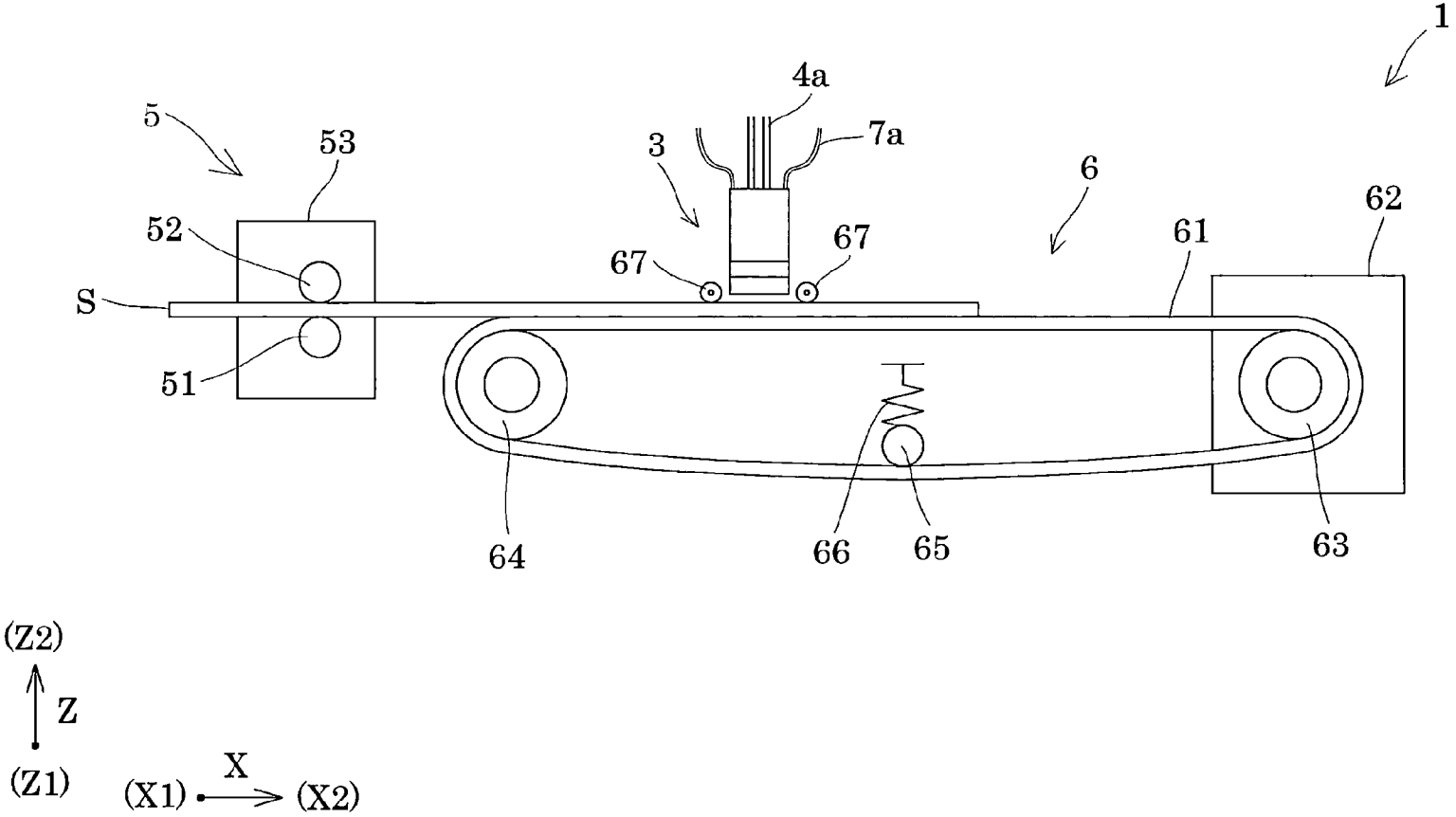
FIG. 2 is a side view illustrating a schematic configuration of the recording apparatus according to Embodiment 1 of the invention.

FIG. 1 is a top view illustrating a schematic configuration of an ink jet type recording apparatus which is an example of a liquid ejecting apparatus according to Embodiment 1 of the invention, and FIG. 2 is a side view of the ink jet type recording apparatus.

As illustrated in the drawings, an ink jet type recording apparatus 1 which is an example of the liquid ejecting apparatus of the embodiment is a so-called line type recording apparatus which performs printing only by transporting a recording sheet S that serves as an ejection target medium.

Here, in the embodiment, a transport direction of the recording sheet S is referred to as a first direction X, and the recording sheet S is transported from an X1 side to an X2 side in a first direction X. In addition, a direction orthogonal to the first direction X in the in-plane direction of a surface on which the ink of the recording sheet S lands is referred to as a second direction Y, one end side in the second direction Y is referred to as Y1, the other end side is referred to as Y2. Furthermore, a direction orthogonal to both the first direction X and the second direction Y, that is, a direction orthogonal to the surface on which the ink of the recording sheet S lands, is referred to as a third direction Z. In addition, in the third direction Z, the liquid ejecting direction side (recording sheet S side with respect to the recording head 3) is referred to as Z1, and the opposite side is referred to as Z2. In the embodiment, an example in which each of the orientations (X, Y, and Z) is orthogonal to one another has been illustrated, but the invention is not necessarily limited thereto.

The ink jet recording apparatus 1 includes: an apparatus main body 2, an ink jet type recording head 3 (hereinafter, also simply referred to as a recording head 3), a storage unit 4, and a first transport unit 5 and a second transport unit 6 which transport the recording sheet S.

The storage unit 4 supplies ink to the recording head 3 as a liquid, and in the embodiment, the storage unit 4 is fixed to the apparatus main body 2. Ink from the storage unit 4 fixed to the apparatus main body 2 is supplied to the recording head 3 via a supply pipe 4*a*, such as a tube. In addition, an aspect in which the recording head 3 includes the storage unit 4, for example, the storage unit 4 may be loaded above the Z2 side of the recording head 3.

The first transport unit 5 is provided on one side in the first direction X of the recording head 3, and in the embodiment, on the X1 side. In addition, in the embodiment, in the first direction X, the upstream side in the transport direction with respect to the recording head 3 is referred to as the X1 side and the downstream side is referred to as the X2 side.

The first transport unit 5 includes a first transport roller 51 and a first driven roller 52 driven by the first transport roller 51. The first transport roller 51 is provided on a side opposite to the surface on which the ink lands on the recording sheet S, that is, on the Z1 side, and is driven by a driving force of the first driving motor 53. In addition, the first driven roller 52 is provided on the side on which the ink lands on the recording sheet S, that is, the Z2 side, and sandwiches the recording sheet S with the first transport roller 51. The first driven roller 52 presses the recording sheet S toward the first transport roller 51 by a biasing member, such as a spring (not illustrated).

The second transport unit 6 includes a transport belt 61, a second driving motor 62, a second transport roller 63, a second driven roller 64, a tension roller 65, and a pressing roller 67.

The second transport roller 63 of the second transport unit 6 is driven by the driving force of the second driving motor 62. The transport belt 61 is configured of an endless belt, and is hung at the outer circumference of the second transport roller 63 and the second driven roller 64. The transport belt 61 is provided on the Z1 side of the recording sheet S. The tension roller 65 is provided between the second transport roller 63 and the second driven roller 64, abuts against the inner circumferential surface of the transport belt 61, and applies tension to the transport belt 61 by a biasing force of a biasing member 66, such as a spring. Accordingly, in the transport belt 61, a surface that faces the recording head 3 between the second transport roller 63 and the second driven roller 64 is disposed to be flat.

The pressing roller 67 of the second transport unit 6 is provided on the X1 side and the X2 side of the recording head 3 on the Z2 side of the recording sheet S. By sandwiching the recording sheet S between the two pressing rollers 67 and the transport belt 61, the posture of the recording sheet S is held to be flat.

In the ink jet type recording apparatus 1, while transporting the recording sheet S toward the recording head 3 in the first direction X from the X1 to the X2 side by the first transport unit 5 and the second transport unit 6, ink is ejected from each of the head main bodies 100 of the recording head 3, and the ejected ink lands on the surface on the Z2 side of the recording sheet S, that is, so-called printing is performed.

Here, an example of the head main body of the embodiment used for the recording head 3 will be described with reference to FIGS. 3 and 4. In addition, FIG. 3 is an exploded perspective view of the head main body and a cover, and FIG. 4 is a sectional view of a part that corresponds to one arbitrary nozzle in the head chip.

Figure 3:
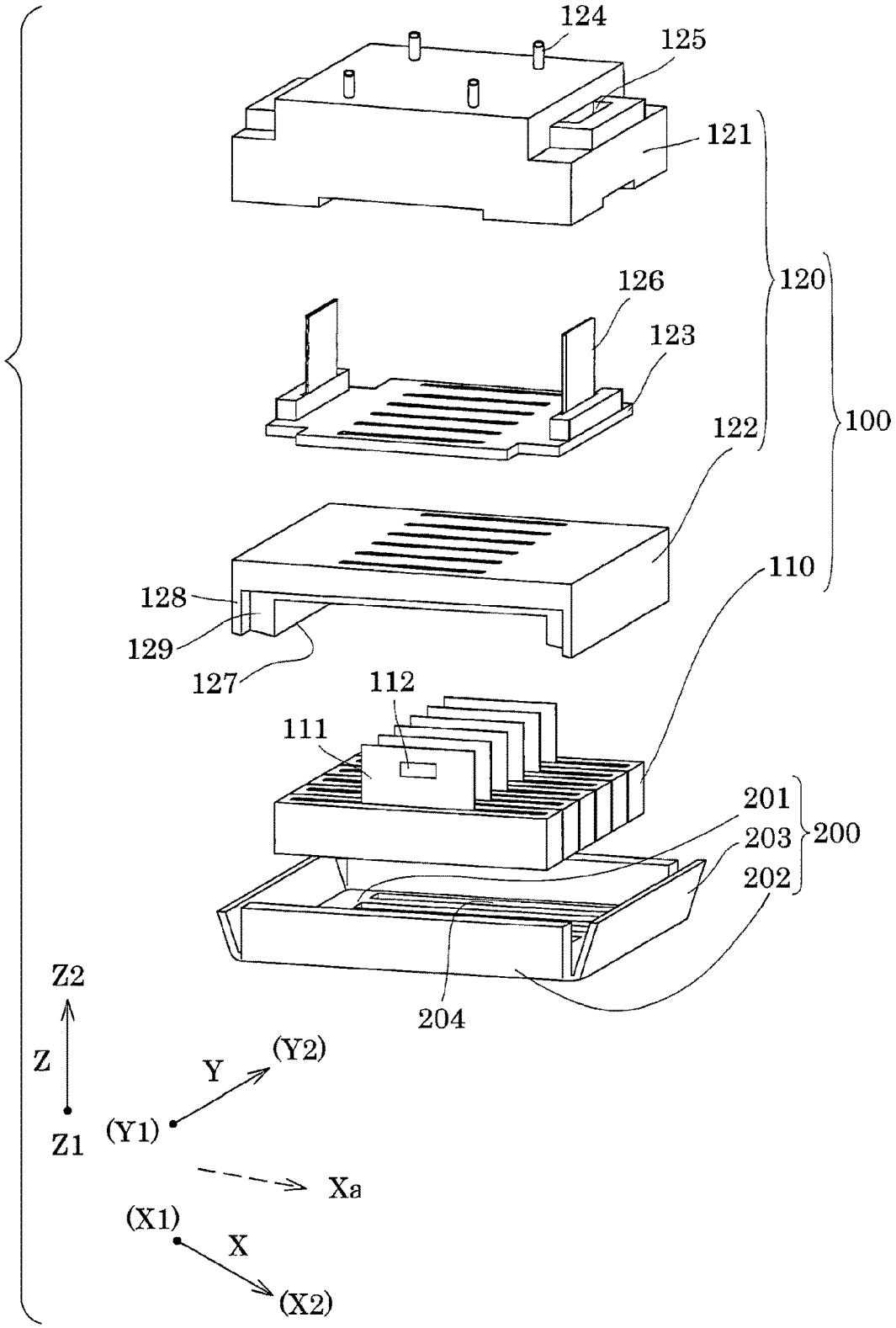
FIG. 3 is an exploded perspective view of a head main body according to Embodiment 1 of the invention.

As illustrated in FIG. 3, the head main body 100 includes a plurality of head chips 110 and a holding member 120 that holds a plurality of head chips 110.

Figure 4:
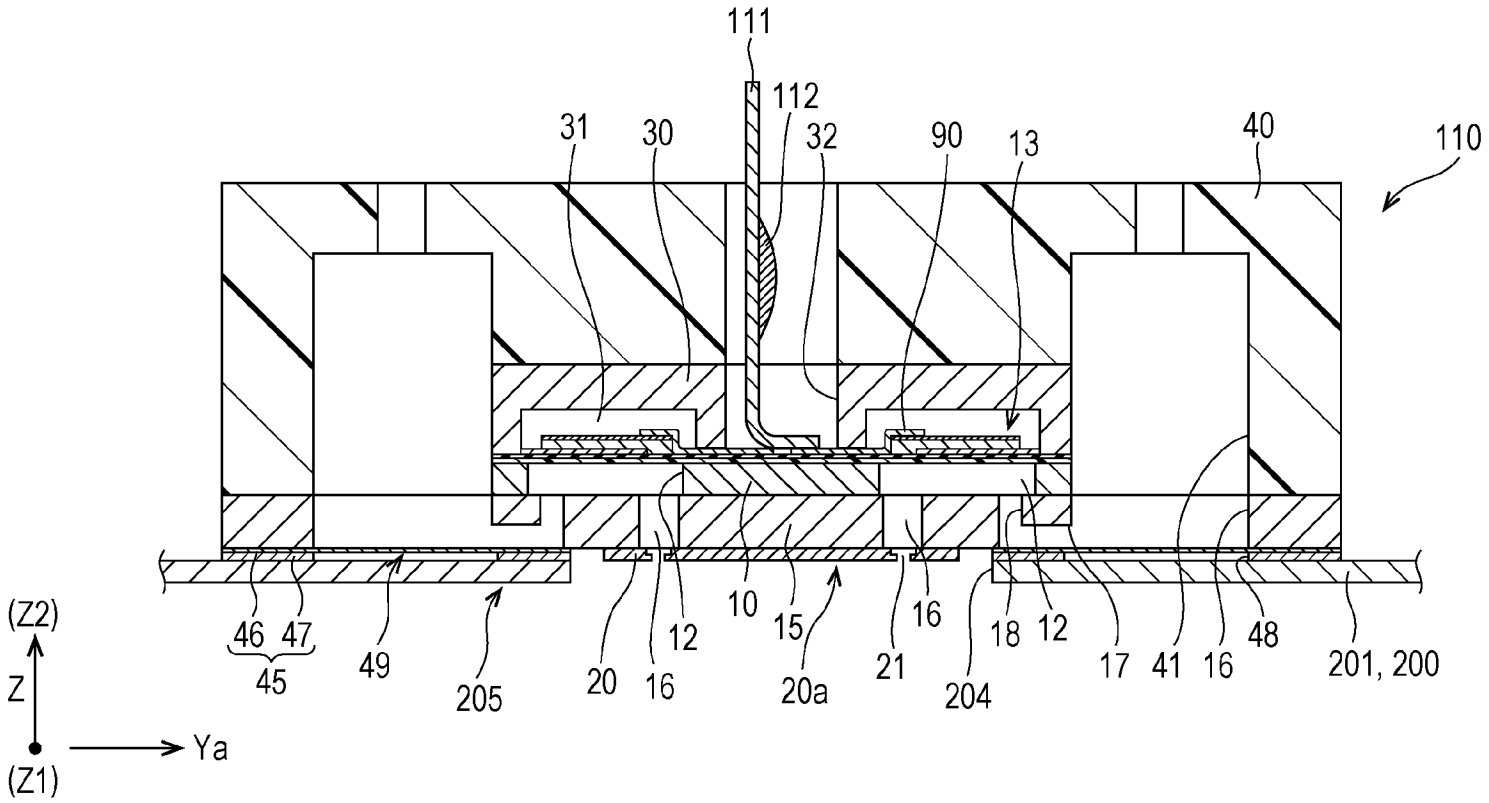
FIG. 4 is a sectional view of a head chip according to Embodiment 1 of the invention.

As illustrated in FIG. 4, the head chip 110 includes a plurality of members, such as a flow path forming substrate 10, a communication plate 15, a nozzle plate 20, a protective substrate 30, a compliance substrate 45, and a case 40, and the plurality of members are joined to each other by an adhesive or the like.

The flow path forming substrate 10, the communication plate 15, the nozzle plate 20, and the protective substrate 30 are formed of, for example, silicon flat plate material, and the case 40 is formed by injection molding of a resin material, for example.

In the flow path forming substrate 10, pressure generating chambers 12 partitioned by a plurality of partition walls are arranged in parallel along a direction in which a plurality of nozzle openings 21 are arranged in parallel. In addition, in the embodiment, the direction in which the pressure generating chambers 12 are arranged in parallel is identical to a fourth direction Xa which will be described later in detail (refer to FIG. 3). Further, on the flow path forming substrate 10, a plurality of rows in which the pressure generating chambers 12 are arranged in parallel in the fourth direction Xa are provided, and in the embodiment, two rows are provided. The arrangement direction in which a plurality of rows of the pressure generating chambers 12 in which the pressure generating chambers 12 are formed along the fourth direction Xa is hereinafter referred to as a fifth direction Ya (refer to FIG. 4). In the head chip 110 of the embodiment is loaded on the recording head 3 such that the fourth direction Xa which is the arrangement direction of the nozzle openings 21, becomes a direction inclined with respect to the first direction X that is the transport direction of the recording sheet S.

In addition, the communication plate 15 is joined to one surface side of the flow path forming substrate 10. The nozzle plate 20 in which a plurality of nozzle openings 21 that communicates with each of the pressure generating chambers 12 are formed, is joined to the communication plate 15. In the embodiment, the Z1 side which is one surface in the third direction Z in which the nozzle opening 21 of the nozzle plate 20 is opened, is a nozzle surface 20*a*.

The communication plate 15 is provided with an opening portion 16, a branched flow path 17 which is a throttle flow path, and a nozzle communication path 18. The branched flow path 17 and the nozzle communication path 18 are through-holes formed for each nozzle opening 21, and the opening portion 16 is an opening that is continuous across the plurality of nozzle openings 21.

In the case 40, a manifold 41 which is a common liquid chamber that communicates with the opening portion 16 of the communication plate 15, is formed. The manifold 41 is a space for storing the ink supplied to the plurality of nozzle openings 21, and is provided continuously across the plurality of nozzle openings 21, that is, the plurality of pressure generating chambers 12. The ink supplied to the manifold 41 is supplied into the pressure generating chamber 12 from the opening portion 16 via the branched flow path 17.

A nozzle opening 21 which communicates with each of the pressure generating chambers 12 via the nozzle communication path 18 is formed in the nozzle plate 20. In other words, the nozzle openings 21 are arranged in parallel in the fourth direction Xa for ejecting the ink which is the same kind of liquid, and two rows of nozzle openings 21 arranged in parallel in the fourth direction Xa are formed in the fifth direction Ya.

Meanwhile, a diaphragm is formed on a side opposite to the communication plate 15 of the flow path forming substrate 10. A first electrode, a piezoelectric layer, and a second electrode are sequentially laminated on the diaphragm, and accordingly, a piezoelectric actuator 13 which is the pressure generating element of the embodiment is configured. In general, one of the electrodes of the piezoelectric actuator 13 is used as a common electrode, and the other electrode and the piezoelectric layer are patterned for each of the pressure generating chambers 12 to form individual electrodes.

In addition, the protective substrate 30 is joined to the surface of the flow path forming substrate 10 on the piezoelectric actuator 13 side. The protective substrate 30 has a holding portion 31 which is a space for protecting the piezoelectric actuator 13. In addition, the protective substrate 30 and the case 40 are provided with through-holes 32 that penetrates in the third direction Z. An end portion of a lead electrode 90 drawn out from the electrode of the piezoelectric actuator 13 extends so as to be exposed in the through-hole 32, and the lead electrode 90 and a first wiring substrate 111 are electrically connected to each other in the through-hole 32. In addition, a driving circuit 112 in which switching elements, such as transmission gates, are provided on the inside for each of the piezoelectric actuators 13 is mounted on the first wiring substrate 111, and based on a head control signal input from the first wiring substrate 111, the switching element of the driving circuit 112 is open and closed to generate a driving signal at a desired timing. In addition, the driving signal generated by the driving circuit 112 is supplied to the piezoelectric actuator 13 via the first wiring substrate 111 and the lead electrode 90.

In addition, a compliance substrate 45 which closes the opening portion 16 is provided on the surface of the communication plate 15 on which the opening portion 16 is open. The pressure fluctuation in the opening portion 16 is absorbed by the flexible deformation of the compliance substrate 45.

In the head chip 110, the ink supplied to the manifold 41 is supplied into the pressure generating chamber 12 via the opening portion 16 and the branched flow path 17. In addition, by changing the pressure in the ink in the pressure generating chamber 12 by driving the piezoelectric actuator 13, the ink is ejected as ink droplets from the nozzle opening 21 that communicates with the pressure generating chamber 12 via the nozzle communication path 18.

A plurality of (in this embodiment, six) such head chips 110 are held by the holding member 120 to configure the head main body 100.

Here, as illustrated in FIG. 3, the holding member 120 which configures the head main body 100 includes a flow path member 121, a holder 122, and a second wiring substrate 123.

The flow path member 121 is provided with a flow path for supplying the ink supplied from a distribution flow path member 400 to the head chip 110 on the inside which is not illustrated. The flow path is provided on the surface on the Z2 side of the flow path member 121, and is provided being open to a tip end surface of a projection portion 124 that protrudes in the third direction Z. In the embodiment, four projection portions 124 are provided on the surface on the Z2 side of the flow path member 121. In other words, four independent flow paths are provided on the inside of the flow path member 121. In addition, a filter for removing foreign substances, such as dust or air bubbles contained in the ink may be provided in the middle of the flow path of the flow path member 121.

The holder 122 is fixed to the surface on the Z1 side of the flow path member 121. In the embodiment, the flow path member 121 and the holder 122 are laminated and fixed to each other in the third direction Z by a first head main body screw member 601 (refer to FIG. 8). In addition, the second wiring substrate 123 is held between the flow path member 121 and the holder 122. The second wiring substrate 123 is configured of a rigid substrate to which the first wiring substrates 111 of the plurality of head chips 110, in the embodiment, six head chips 110, are commonly electrically connected. In addition, although not specifically illustrated, electronic components, such as circuits for communication, are mounted on the second wiring substrate 123. In addition, in the embodiment, the driving circuit 112 having the switching element is provided on the first wiring substrate 111, but the invention is not particularly limited thereto, and a driving circuit having a switching element may be mounted on the second wiring substrate 123.

In addition, cable insertion holes 125 which penetrate in the third direction Z are provided in both of the end portions of the flow path member 121 in the first direction X, respectively. A first cable 126 inserted through the cable insertion hole 125 from the Z1 side of the flow path member 121 is connected to the second wiring substrate 123 held between the flow path member 121 and the holder 122.

In addition, the holder 122 has a holding portion 127 that forms a groove-like space on the Z1 side. The holding portion 127 is provided continuously on the Z1 side surface of the holding member 120 in the second direction Y so as to be open on both of the side surfaces in the second direction Y. In addition, the holding member 120 includes the holding portion 127 provided in the substantially center portion in the first direction X, so that a foot portion 128 is formed on both sides of the holding portion 127 in the first direction X. In other words, the foot portion 128 is provided only in both of the end portions in the first direction X on the surface on the Z1 side of the holding member 120, and is not provided in both of the end portions in the second direction Y.

Figure 7:
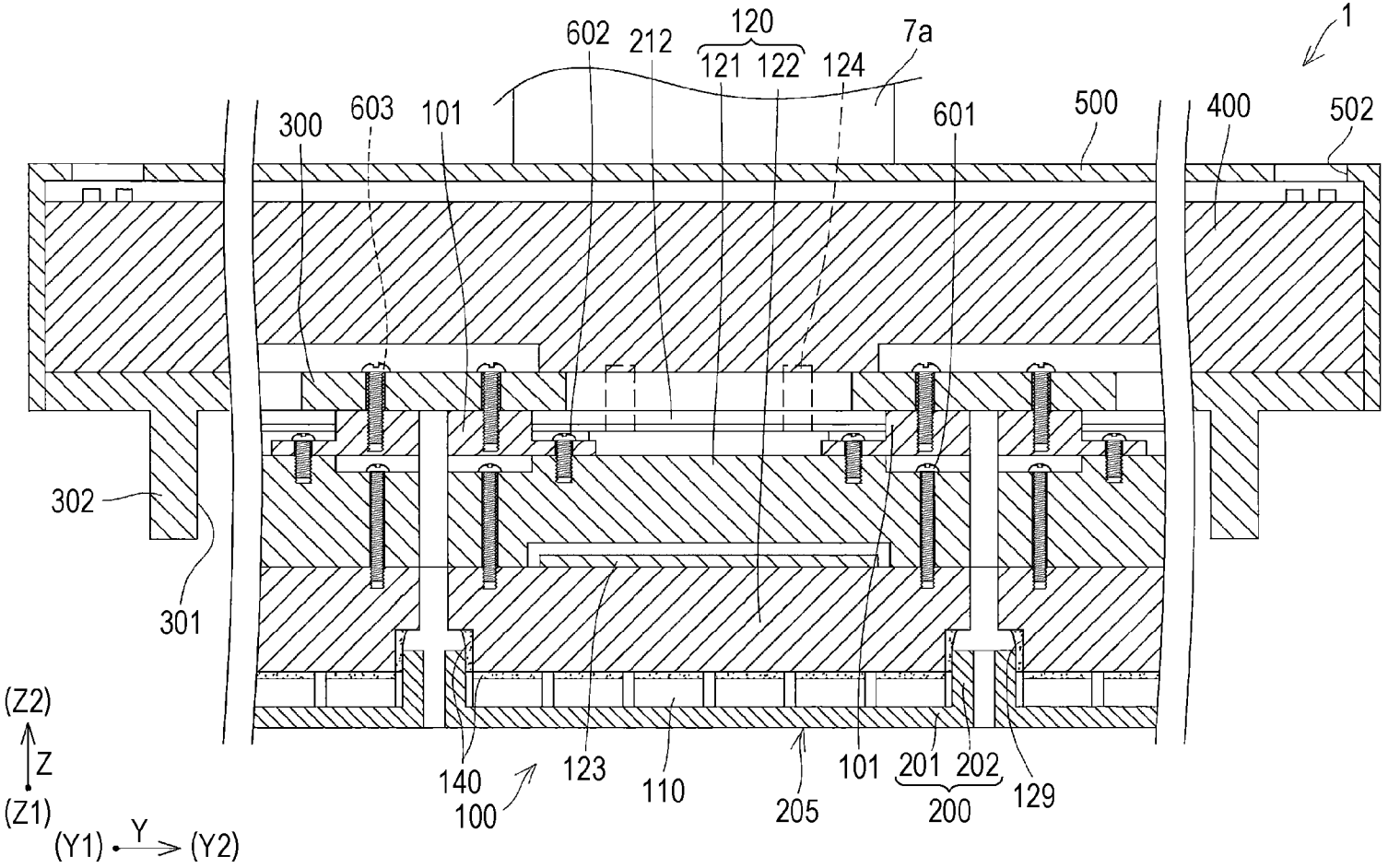
FIG. 7 is a sectional view of main portions of a recording head according to Embodiment 1.

A plurality of head chips 110 adhere to the holding portion 127 by an adhesive 140 (refer to FIG. 7). In other words, the foot portion 128 are positioned on both sides of the head chip 110 in the first direction X. In addition, on the inside of the holder 122 (not illustrated), a flow path that communicates with a flow path provided on the inside of the flow path member 121 is provided. The ink supplied from the flow path member 121 is supplied to the plurality of head chips 110 via the flow path on the inside of the holder 122.

In addition, in the holding portion 127 of the holder 122, a plurality of head chips 110 are arranged in parallel in the second direction Y. In the embodiment, six head chips 110 adhere to one holding member 120. It is needless to say that the number of the head chips 110 to be fixed to one holding member 120 is not limited to the description above, and one head chip 110 may be employed, and two or more plural head chips 110 may be employed for one holding member 120. However, by providing a plurality of head chips 110 to one head main body 100 similar to the embodiment to achieve multi-row nozzle rows, it is possible to improve yield compared to a case where a plurality of nozzle rows are provided only in one head chip 110 to one head main body 100.

In addition, the plurality of head chips 110 of the embodiment are fixed such that the nozzle row is inclined with respect to the first direction X which is the transport direction of the recording sheet S in the in-plane direction of the nozzle surface 20*a*. In other words, in the first direction X, the fourth direction Xa which is the arrangement direction of the nozzle openings 21 that configures the nozzle row, is an inclined direction. In this manner, the fourth direction Xa which is the arrangement direction of the nozzle openings 21 of the head chip 110, is disposed to be inclined with respect to the first direction X, the plurality of head chips 110 are arranged in parallel in the second direction Y, and accordingly, it is possible to dispose at least a part of the nozzle openings 21 of the adjacent head chips 110 in the second direction Y at positions overlapping in the first direction X.

Figure 8:
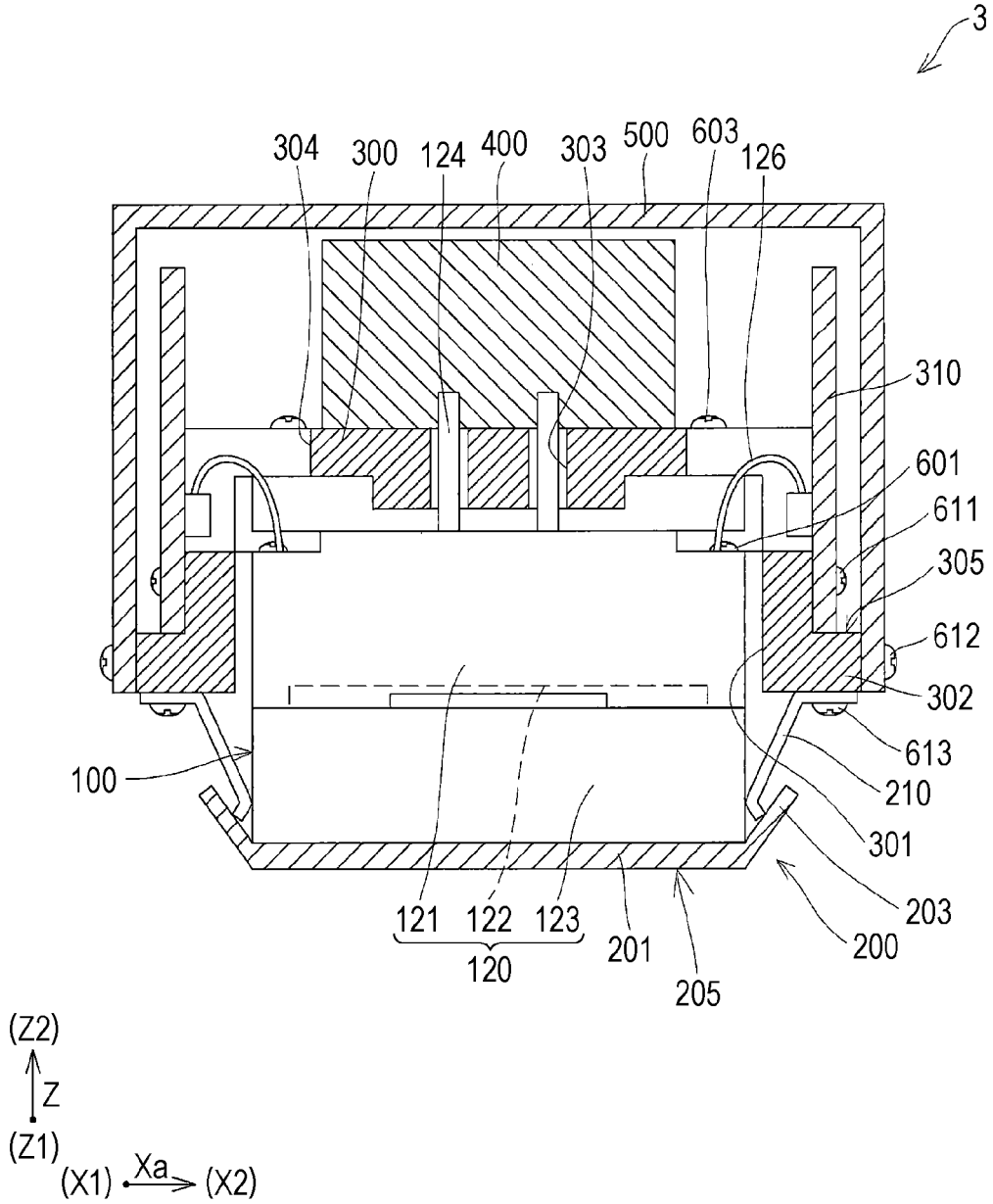
FIG. 8 is a sectional view of main portions of the recording head according to Embodiment 1.

The recording head 3 of the embodiment having the head main body 100 will be described with reference to FIGS. 5 to 8. In addition, FIG. 5 is an exploded perspective view illustrating an ink jet type recording head which is an example of a liquid ejecting head according to Embodiment 1 of the invention, FIG. 6 is a plan view of a liquid ejecting surface side of the ink jet type recording head, FIG. 7 is a sectional view of main portions taken along line VII-VII of FIG. 6, and FIG. 8 is a sectional view of main portions taken along the line VIII-VIII of FIG. 6.

Figure 5:
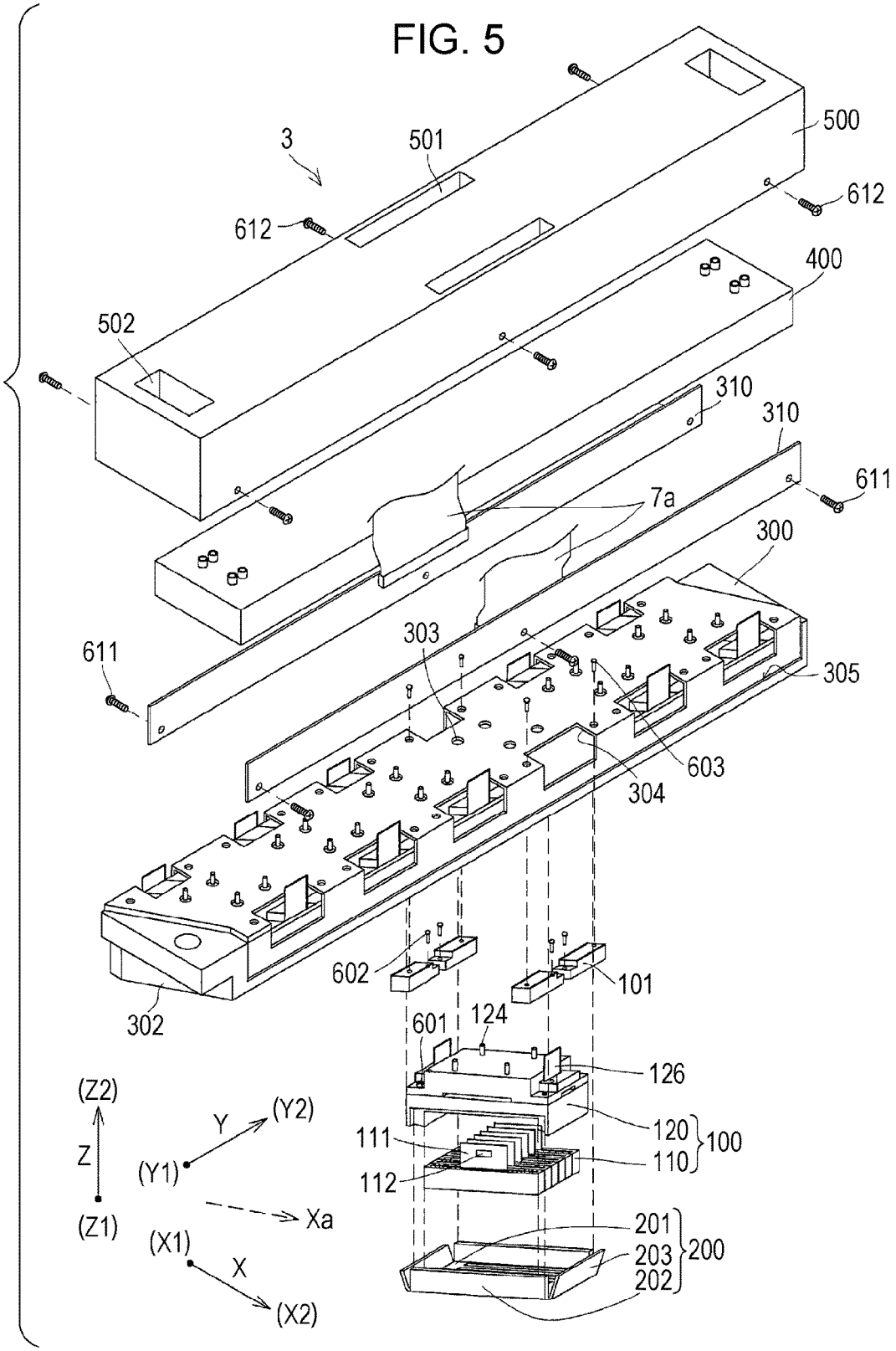
FIG. 5 is an exploded perspective view of a recording head according to Embodiment 1.
Figure 6:
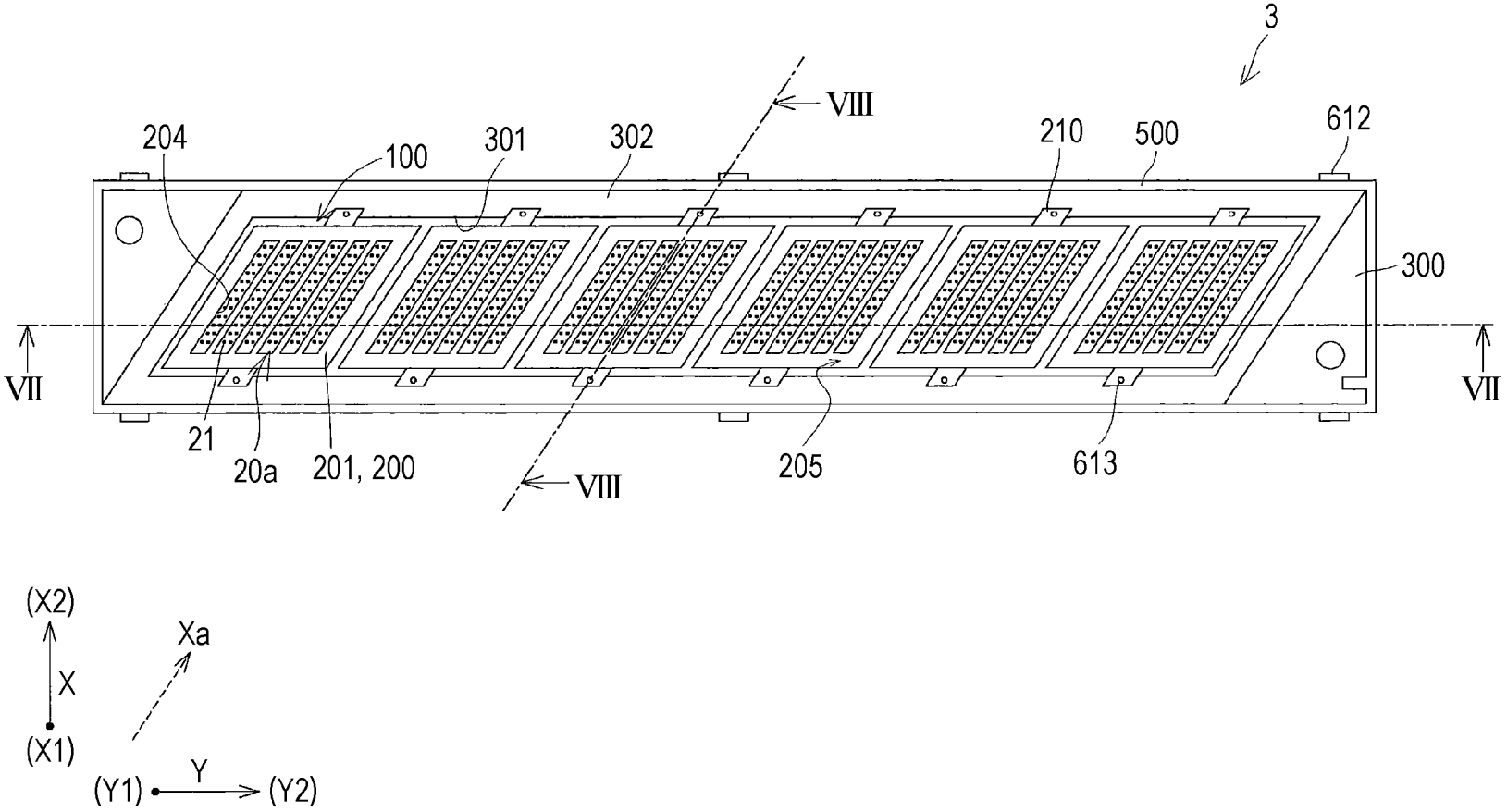
FIG. 6 is a plan view of a recording head according to Embodiment 1.

As illustrated in FIG. 5, the recording head 3 of the embodiment includes a plurality of the above-described head main bodies 100, a plurality of covers 200, a base 300, the distribution flow path member 400, and a base cover 500.

As illustrated in FIG. 3, the cover 200 is made of a plate-like member formed of a material having conductivity, such as metal, for example, a plate-like member formed of stainless steel (SUS).

The cover 200 is provided on the nozzle surface 20*a* side of the plurality of head chips 110 provided in the head main body 100, that is, on the Z1 side in the third direction Z of the head main body 100. In the embodiment, the cover 200 is joined to the surface on the Z1 side in the third direction Z of the holding member 120 of the head main body 100, that is, the end surface on the Z1 side of the foot portion 128 via an adhesive (not illustrated).

In addition, as illustrated in FIG. 6, in the embodiment, the cover 200 is provided on the nozzle surface 20*a* side of the head main body 100 independently for each head main body 100, that is, without being continuous with the plurality of head main bodies 100. It is needless to say that the cover 200 may be provided continuously for each group of the head main bodies 100 configured with a plurality of head main bodies 100. However, when the cover 200 is provided continuously for each group of the head main bodies 100, the number of configuration elements when the group of the head main bodies 100 and the cover 200 are unitized increases, there is a concern that the yield deteriorates. In addition, both the positioning of the head chips 110 with each other and the relative positioning of the head main bodies 100 with each other must be performed when forming the head chips 110 into a unit, and there is a concern that positioning work becomes complicate. In the embodiment, by providing the cover 200 for each of the head main bodies 100, it is possible to improve the yield, to perform the positioning of the head chips 110 with each other and the positioning of the head main bodies 100 with each other in separate processing, and to simplify the positioning work.

In addition, as illustrated in FIG. 4, the cover 200 is fixed to the head chip 110 provided in each of the head main bodies 100 on the surface on the Z1 side. In the embodiment, one cover 200 is provided commonly to the plurality of head chips 110 that configures one head main body 100. It is needless to say that the cover 200 is not limited to a configuration of being provided commonly to all of the head chips 110 provided in one head main body 100, and one cover 200 may be provided independently for each head chip 110, or may be provided independently for each group configured with two or more plural head chips 110. However, as described in the embodiment, by providing the cover 200 commonly to all of the head chips 110 that configure one head main body 100 and fixing the head chip 110 to the cover 200, it is possible to use the cover 200 when positioning the nozzle openings of the plurality of head chips 110 relatively, and to perform the positioning of a nozzle surfaces of the plurality of head chips 110 in the third direction Z with high accuracy.

Specifically, as illustrated in FIG. 3, the cover 200 includes a base portion 201, a first extending portion 202, and a second extending portion 203.

The base portion 201 is configured with a plate-shaped member provided on the nozzle surface 20*a* side, and is joined to the surface on the Z1 side of the holding member 120 in the third direction Z, that is, the end surface on the Z1 side of the foot portion 128 by the adhesive (not illustrated). The Z1 side of the holding portion 127 of the holding member 120 is covered with the base portion 201 as described above.

In addition, as illustrated in FIGS. 4 and 6, the base portion 201 is provided with an exposure opening portion 204 for opening the nozzle opening 21 of each of the head chips 110. In the embodiment, the exposure opening portion 204 is provided so as to be open independently for each of the head chips 110. In other words, since the head main body 100 of the embodiment has six head chips 110, six independent exposure opening portions 204 are provided in the base portion 201. It is needless to say that, depending on the configuration or the like of the head chip 110, one common exposure opening portion 204 may be provided for a group configured with a plurality of head chips 110.

In addition, the exposure opening portion 204 is provided so as to open along the fourth direction Xa which is the arrangement direction of the nozzle openings 21. In other words, when viewed in a plan view from the third direction Z, the exposure opening portion 204 has a parallelogram in which both side surfaces in the second direction Y are provided in the direction along the fourth direction Xa. In addition, in the embodiment, the exposure opening portion 204 has an opening slightly greater than the nozzle plate 20, and the cover 200 is joined to the compliance substrate 45 of each of the head chips 110 via an adhesive (not illustrated). Therefore, the periphery of the nozzle plate 20 of the head chip 110 is covered with the cover 200. Therefore, it is possible to suppress deformation or destruction caused by the recording sheet S that abuts against the head chip 110, by the cover 200. In other words, the cover 200 also functions as a protective member for protecting the head chip 110 and the nozzle surface 20*a* side of the head main body 100. In addition, by fixing each of the head chips 110 to the common cover 200, it is possible to fix the nozzle openings of each of the head chips 110 to the cover 200 by relatively positioning the nozzle openings, to align the positions of the nozzle surfaces 20*a* of the plurality of head chips 110 in the third direction Z, and to improve printing accuracy by allowing the ink droplets to land with high accuracy.

As illustrated in FIGS. 3 and 7, the first extending portion 202 extends from both of the end portions in the second direction Y of the base portion 201 toward the Z2 side, and is configured with a plate-like member having a size that covers the opening of the holding portion 127 in the second direction Y. In the embodiment, the first extending portion 202 is provided along the third direction Z. The first extending portion 202 adheres to the side surface of the foot portion 128 in the second direction Y by an adhesive 140. Accordingly, the inside of the holding portion 127 which is the space between the holder 122 that holds the head chip 110 and the cover 200, is sealed, and it is possible to suppress intrusion of moisture, such as ink, into the holding portion 127. In addition, by making the first extending portion 202 and the holder 122 adhere to each other, a foot portion for adhering to the base portion 201 of the cover 200 becomes unnecessary on both sides in the second direction Y of the holder 122. Therefore, when the head main body 100 is arranged in parallel in the second direction Y, the foot portion does not exist between the head main bodies 100 adjacent to each other, and thus, it is possible to narrow the distance between the adjacent head main bodies 100 in the second direction Y. Accordingly, it is possible to provide the head chips 110 of the head main bodies 100 that are adjacent in the second direction Y to be close to each other. In addition, in the embodiment, a recess portion 129 is provided on the side surface of the holder 122 in the second direction Y, and the first extending portion 202 adheres to the inside the recess portion 129. Therefore, the amount of projection of the first extending portion 202 in the second direction Y is reduced, and the interval between the head main bodies 100 adjacent to each other in the second direction Y can be further narrowed.

As illustrated in FIGS. 3 and 8, the second extending portion 203 is a plate-like member which extends from both of the end portions of the base portion 201 in the first direction X toward the Z2 side. The second extending portion 203 is provided to be inclined in a direction of being separated from the holding member 120 on the Z2 side, compared with the Z1 side on the base portion 201 side in the third direction Z. In other words, the second extending portion 203 is provided not to extend perpendicularly to the base portion 201 such that the width of the two second extending portions 203 that oppose each other in the second direction Y widens to the side opposite to the base portion 201 compared to the width on the base portion 201 side. Accordingly, a gap is formed between the second extending portion 203 and the side surface of the holding member 120 in the first direction X.

In the cover 200, a surface which faces the recording sheet S, that is, at least a surface on the Z1 side of the base portion 201 is a liquid repellent surface 205. In the embodiment, by providing a liquid repellent film (not illustrated) over the surface of the base portion 201, the first extending portion 202, and the second extending portion 203 on the side opposite to the head main body 100, the liquid repellent surface 205 is achieved. In addition, the liquid repellent surface 205 refers to a material having liquid repellency to the ink than a base material of the cover 200. The liquid repellent film used as the liquid repellent surface 205 is not particularly limited as long as the liquid repellent film has liquid repellency to the ink, and for example, a metal film containing a fluorine-based polymer, a molecular film of an alkoxide having liquid repellency, or the like, can be used. In this manner, by setting at least a surface on which the cover 200 which faces the recording sheet S in the cover 200, that is, by setting the surface on the surface on the Z1 side of the base portion 201 as the liquid repellent surface 205, it is possible control adhesion of ink to the cover 200. In addition, by not providing the liquid repellent film on the surface side of the cover 200 to which the head main body 100 is joined, it is possible to reliably join the cover 200 and the head main body 100 to each other. Furthermore, by not providing the liquid repellent film on the surface of the cover 200 on the head main body 100 side, specifically, by allowing the conduction portion 210 which will be described in detail later to abut against the surface on the head main body 100 side on which the liquid repellent film of the cover 200 is not provided, it is possible to reliably conduct the conduction portion 210 and the cover 200 to each other. In other words, in a case of using a molecular film of a metal alkoxide as the liquid repellent film, when the liquid repellent film is provided on the surface of the cover 200 on the head main body 100 side, it becomes difficult to conduct the conduction portion 210 and the cover 200 to each other. Incidentally, in a case of using a metal film containing a fluorine-based polymer as the liquid repellent film, even when the liquid repellent film is provided on the head main body 100 side of the cover 200, only by bringing the conduction portion 210 and the liquid repellent film into contact with each other, the conduction is possible, and thus, it is possible to achieve the conduction between the conduction portion 210 and the cover 200 to each other.

As illustrated in FIGS. 5 to 8, in the embodiment, the base 300 is made of a material having conductivity, such as metal. By manufacturing the base 300, for example, by aluminum die casting, it is possible to manufacture the base 300 at low cost and with high accuracy. It is needless to say that the base 300 is not limited to a material having conductivity, and may be formed of a material, such as resin.

The base 300 holds a plurality of head main bodies 100, and as illustrated in FIGS. 6 and 7, a wall portion 302 in which an accommodation portion 301 which is a space that opens toward the Z1 side is provided, is provided. A part of the plurality of head main bodies 100 on the Z2 side is accommodated in the accommodation portion 301 of the base 300. In the embodiment, the nozzle surface **20*a* side of the head main body 100 protrudes toward the Z1 side from the wall portion 302 and is accommodated in the accommodation portion 301. In other words, the base 300 is disposed to be separated from the plurality of covers 200, nipping at least one of the driving circuit 112 which is a switching element provided in the head main body 100 with the cover 200 and a piezoelectric actuator 13 which is a pressure generating element. In the embodiment, since both of the driving circuit 112 and the piezoelectric actuator 13 are contained on the inside of the head main body 100, between the plurality of covers 200 and the base 300 disposed to be separated from each other, both of the driving circuit 112 and the piezoelectric actuator 13** are nipped.

In addition, the accommodation portion 301 of the embodiment has a size capable of accommodating a plurality of head main bodies 100, and in this embodiment, six head main bodies 100, in one accommodation portion 301. In addition, the accommodation portion 301 has a size to the extent that the wall portion 302 does not abut against the side surface of the head main body 100 when accommodating the plurality of head main bodies 100.

In addition, as illustrated in FIG. 6, when viewed in a plan view from the nozzle surface **20*a* side in the third direction Z, shapes on both sides in the second direction Y which is the arrangement direction of the head main bodies 100, are shapes in the fourth direction Xa. In other words, the side surfaces on the Z1 side of the head main body 100 on both sides in the second direction Y are provided to be inclined in the same direction as the fourth direction Xa which is the arrangement direction of the nozzle openings 21. In addition, the plurality of head main bodies 100 are arranged in parallel along a straight line in a second direction Y orthogonal to the first direction X which is the transport direction, and are fixed in the accommodation portion 301 of the base 300. In this manner, by setting side surfaces on both sides in the arrangement direction of the head main body 100 to have a direction the same as the fourth direction Xa which is the arrangement direction of the nozzle opening 21, even when the plurality of head main bodies 100 are disposed along the straight line in the second direction Y, it is possible to dispose at least a part of the nozzle opening 21 of the head main bodies 100 adjacent to each other in the second direction Y, at positions overlapping the first direction X. Therefore, it is possible to form the nozzle openings 21 arranged in parallel at the same interval in the second direction Y of the recording head 3. In addition, by disposing the plurality of head main bodies 100 along the straight line in the second direction Y, it is possible to reduce the width of the recording head 3 in the first direction X, and to reduce the size of the recording head 3. In other words, in the embodiment, since the plurality of head main bodies 100 are not disposed in the first direction X, it is possible to reduce the size in the first direction X. It is needless to say that the head main body 100 arranged in parallel in the second direction Y may be disposed to be shifted in the first direction X. However, when the head main body 100 is largely shifted in the first direction X, the width of the base 300 or the like in the first direction X is wider than that in the embodiment. When the size of the recording head 3 in the first direction X is increased in this manner, the distance in the first direction X between the two pressing rollers 67 in the ink jet type recording apparatus 1 is increased, and there is a concern that it is difficult to fix the posture of the recording sheet S. In addition, there is a concern that the size of the recording head 3 and the ink jet type recording apparatus 1** increases.

In addition, the shape of the head main body 100 when viewed in a plan view from the nozzle surface 20*a* side is not limited to a substantially parallelogram shape, but may be a rectangular shape, a trapezoidal shape, a polygonal shape, or the like. In addition, in the embodiment, the six head main bodies 100 are fixed to the base 300, but the number of the head main bodies 100 is not particularly limited, and may be one or plural, for example, two or more.

In addition, in the embodiment, the plurality of head main bodies 100 are arranged in parallel in the second direction Y with spaces being provided between the head main bodies 100 adjacent to each other. In other words, the head main bodies 100 adjacent to each other are disposed with gaps therebetween without the surfaces in the second direction Y abutting against each other. By providing a space between the head main bodies 100 arranged in parallel in the second direction Y in this manner, it is possible to relatively position the nozzle openings 21 of the plurality of head main bodies 100. In addition, spaces are also provided between the plurality of head main bodies 100 and the wall portion 302 which forms the accommodation portion 301 for accommodating the plurality of head main bodies 100 therein. By providing a space between the head main bodies 100 and the wall portion 302, it is possible to relatively position the nozzle openings 21 of the plurality of head main bodies 100 in the accommodation portion 301.

In addition, in the embodiment, one accommodation portion 301 which accommodates the plurality of head main bodies 100 is provided, however, not being limited thereto, the accommodation portion 301 may be provided independently for one head main body 100 or two or more head main bodies 100. However, in a case where the accommodation portion 301 is divided, the wall portion 302 is provided between the head main bodies 100 adjacent to each other in the second direction Y, the space between the adjacent head main bodies 100 is increased, the size of the recording head 3 increases in the second direction Y, and it becomes difficult to dispose the nozzle openings 21 of the adjacent head main bodies 100 at the same position in the first direction X. In the embodiment, by accommodating the plurality of head main bodies 100 in one accommodation portion 301, it is possible to dispose the head main bodies 100 at a high density, to reduce the size of the recording head 3 in the second direction Y, and to easily dispose the nozzle openings 21 of the adjacent head main bodies 100 at the same position in the first direction X.

In addition, in the embodiment, the head main body 100 is fixed to the base 300 via a spacer 101, as illustrated in FIGS. 5 and 7. The spacer 101 is fastened to the surface on the Z2 side of the head main body 100 by a second head main body screw member 602. In addition, the spacer 101 is fastened to the surface on the Z1 side of the base 300 by a third head main body screw member 603. Accordingly, the head main body 100 is fixed to the base 300 via the spacer 101. In addition, by fixing the spacer 101 fixed to the head main body 100 by the second head main body screw member 602 with the third head main body screw member 603 to the base 300, it is possible to easily attach and detach the head main body 100 to and from the base 300. Incidentally, the fixing of the spacer 101 and the head main body 100 is not limited to fixing by the second head main body screw member 602, but may be fixed by adhesion with an adhesive. In addition, the spacer 101 may be provided integrally with a part of the head main body 100.

In addition, a supply hole 303 which penetrates in the third direction Z is provided on the base 300. The flow path of the head main body 100 fixed to the base 300 is exposed to the surface on the Z2 side by the supply hole 303, and the distribution flow path member 400 is connected to the flow path exposed by the supply hole 303.

In addition, as illustrated in FIGS. 5 and 8, a first cable opening portion 304 for inserting the first cable 126 of the head main body 100 is provided on the base 300. In the embodiment, the first cable opening portion 304 is provided one by one on both sides in the first direction X for each of the head main bodies 100. In other words, a total of two first cable opening portions 304 are provided for each of the head main bodies 100. The first cable 126 of the head main body 100 fixed in the accommodation portion 301 of the base 300 via the first cable opening portion 304 is led out to the outside of the accommodation portion 301, that is, the Z2 side of the base 300.

In addition, a step 305 which is open toward the Z2 side is provided at the outer circumference of each of the wall portions 302 on both sides in the first direction X in the wall portion 302, and circuit boards 310 are accommodated in each of the steps 305. In other words, the end surface on the Z1 side which is the nozzle surface 20*a* side of the circuit board 310, is covered with the wall portion 302. A plurality of first cables 126 led out toward the Z2 side from the first cable opening portion 304 are electrically connected to the circuit board 310. In the embodiment, the circuit board 310 has a length extending across the plurality of head main bodies 100 in the second direction Y, in the embodiment, six head main bodies 100. In addition, the two circuit boards 310 are arranged in parallel in the second direction Y in the in-plane direction of the nozzle surface 20*a*.

In this manner, by connecting the first cable 126 of the plurality of head main bodies 100 to the common circuit board 310 by inserting the first cable opening portion 304 which is open to the Z2 side of the base 300, it is possible to make intrusion of ink mist on the nozzle surface 20*a* side from the first cable opening portion 304 difficult, and it is possible to suppress the adhesion of ink to the first cable 126 or the second wiring substrate 123 of the head main body 100.

In addition, a control cable 7*a* from a controller 7 fixed to the apparatus main body 2 is connected to the circuit board 310. In the embodiment, one control cable 7*a* is connected to each of the circuit boards 310. Furthermore, although not specifically illustrated, a wiring for grounding is provided on the circuit board 310, and the wiring for grounding of the circuit board 310 is grounded via the controller 7.

In addition, the circuit board 310 is fixed to the wall portion 302 of the base 300 by a first screw member 611. The wiring for grounding (not illustrated) provided on the circuit board 310 is conducted to the base 300 via the first screw member 611. In other words, the first screw member 611 also functions as a member which conducts the circuit board 310 and the base 300 to each other.

As illustrated in FIGS. 5 and 8, a distribution flow path member 400 is provided on the surface on the Z2 side of the base 300 as described above.

The distribution flow path member 400 distributes and supplies the ink supplied from the storage unit 4 to each of the head main bodies 100, the supply pipe 4*a* (refer to FIG. 1) connected to the storage unit 4 is connected to the inside thereof which is not illustrated, and the distribution path connected to the flow path of the head main body 100 is provided. The ink supplied to each color or each different type is supplied to the plurality of head main bodies 100 distributed by the distribution flow path.

As illustrated in FIGS. 5, 7, and 8, the base cover 500 is a box-shaped member that is provided on the Z2 side of the base 300 and covers the distribution flow path member 400 and the circuit board 310 on the Z2 side of the base 300.

The base cover 500 is provided with a control cable opening portion 501 for inserting the control cable 7*a*, and the control cable 7*a* is inserted into the control cable opening portion 501 and connected to the internal circuit board 310.

In addition, a supply pipe opening portion 502 for inserting the supply pipe 4*a* is provided in the base cover 500, and the supply pipe 4*a* inserted into the supply pipe opening portion 502 is connected to the distribution flow path member 400.

In the embodiment, the base cover 500 is made of a material having conductivity, such as metal. In addition, the base cover 500 is fixed to the wall portion 302 of the base 300 by a second screw member 612. The second screw member 612 is formed of a material having conductivity, such as metal. Therefore, the base cover 500 is conducted to the base 300 via the second screw member 612.

In addition, as illustrated in FIGS. 6 and 8, the recording head 3 is provided with the conduction portion 210 for conducting the base 300 and the cover 200 at a plurality of positions. In the embodiment, the conduction portion 210 which abuts against and conducts to each of the second extending portions 203 provided on both sides in the first direction X of the cover 200, is provided.

Here, the conduction portion 210 is configured of a spring-shaped plate member having conductivity, that is, a so-called plate spring. One end of the conduction portion 210 is fixed to the surface on the Z1 side of the wall portion 302 of the base 300 by a third screw member 613, and the other end is a free end. In addition, the tip end which becomes a free end of the conduction portion 210 is disposed on the back side of the second extending portion 203 of the cover 200, that is, on the surface of the second extending portion 203 on the holding member 120 side to abut against the center portion in the first direction X at a predetermined pressure. By the conduction portion 210, the base 300 having conductivity and the cover 200 are conducted to each other. In other words, the cover 200 having conductivity is conducted to the base 300 having conductivity via the conduction portion 210. In addition, as described above, the base 300 is grounded as being electrically conducted to the circuit board 310 connected via the control cable 7*a*, via the second screw member 612. Therefore, one cover 200 is grounded via a plurality of, in the embodiment, two conduction portions 210. In other words, by conducting the circuit board 310 which is grounded via the control cable 7*a* and the base 300 to each other, the base 300 is grounded, and by conducting the base 300 which is grounded via the control cable 7*a* and the conduction portion 210 and the circuit board 310 to each other, the conduction portion 210 is grounded. Therefore, the cover 200 is grounded via the plurality of conduction portion 210. It is needless to say that the conduction portion 210 may be conducted to the circuit board 310 without passing through the base 300 but via another member, such as a conductive wire. In addition, the conduction portion 210 may not be a spring as long as the conduction portion 210 has conductivity.

In the embodiment, the conduction portions 210 are provided to conduct to each of the second extending portions 203 provided on both sides in the first direction X of the cover 200. In other words, in the in-plane direction of the nozzle surface 20*a* of the head main body 100, two conduction portions 210 are provided at positions in the fourth direction Xa nipping the piezoelectric actuator 13 which is a pressure generating element or the driving circuit 112 having a switching element. In other words, in the embodiment, the piezoelectric actuator 13 which is a pressure generating element and the driving circuit 112, are positioned between the two conduction portions 210 provided on both sides of one cover 200 in the fourth direction Xa.

In other words, the plurality of head main bodies 100 are arranged on the nozzle surface 20*a* of the head main body 100, the plurality of conduction portions 210 are arranged on the nozzle surface 20*a* of the head main body 100, and the second direction Y in which a plurality of head main bodies 100 are arranged, and the fourth direction Xa in which the plurality of conduction portions 210 are arranged intersect each other. In addition, the plurality of conduction portions 210 may be provided to be arranged in the first direction X. In other words, the direction in which the plurality of head main bodies 100 are arranged and the direction in which the plurality of conduction portions 210 are arranged may be orthogonal to each other.

In addition, the plurality of conduction portions 210 provided for one cover 200 are positioned on the same side with respect to the cover 200 in the direction orthogonal to the in-plane direction of the nozzle surface 20*a* of the head main body 100. Here, a case where the plurality of conduction portions 210 are positioned on the same side with respect to the cover 200 means that the plurality of conduction portions 210 commonly comes into contact with only one of the surfaces of the cover 200. In other words, the plurality of conduction portions 210 commonly comes into contact with the surface of the cover 200 on the head main body 100 side, or the surface opposite to the head main body 100. In the embodiment, since the two conduction portions 210 provided for one cover 200 are commonly in contact with the surface of the cover 200 on the head main body 100 side, it can be said that the plurality of conduction portions 210 provided for one cover 200 are positioned on the same side with respect to the cover 200. In this manner, as the plurality of conduction portions 210 are positioned on the same side with respect to the cover 200, it is possible to suppress application of uneven pressure to the cover 200 by the pressure at which the conduction portion 210 comes into contact with the cover 200, and to suppress deviation of the nozzle opening 21 due to positional deviation between the cover 200 and the head main body 100. In other words, in the two conduction portions 210, in a case where one of the conduction portions 210 abuts against the side opposite to the head main body 100 of one second extending portion 203, and the other conduction portion 210 abuts against the head main body 100 side of the other second extending portion 203, a stress is applied to the cover 200 in the same direction as the first direction X by the contact pressure of the two conduction portions 210, the cover 200 and the head main body 100 are likely to be deviated in the first direction X, and the position deviation of the nozzle opening 21 is likely to be generated.

In addition, in the embodiment, the conduction portion 210 conducts by abutting against the side opposite to the liquid repellent surface 205 of the second extending portion 203 of the cover 200. Therefore, even when an insulating material is used as the liquid repellent film that forms the liquid repellent surface 205, the conduction portion 210 can conduct to the cover 200. Therefore, the material of the liquid repellent film that forms the liquid repellent surface 205 is not limited, and a material having high liquid repellency as the liquid repellent surface 205, for example, a molecular film of a metal alkoxide or the like can be used. It is needless to say that the conduction portion 210 may conduct to the cover 200 by abutting against the side opposite to the head main body 100 of the second extending portion 203 of the cover 200. In this case, for example, the liquid repellent film may not be provided only at a part against which at least the conduction portion 210 of the second extending portion 203 abuts.

In addition, by connecting the cover 200 to the ground via the plurality of conduction portions 210, in the embodiment, the two conduction portions 210, it is possible to suppress generation of noise due to connection failure of the cover 200 to the ground, that is, so-called ground failure. In other words, when the connection of the cover 200 to the ground is insufficient, the cover 200 acts similar to a flat antenna, and the noise generated from the piezoelectric actuator 13 which is a pressure generating element and the driving circuit 112 having a switching element, is radiated to the outer space by the cover 200. In particular, similar to the embodiment, in a case where the cover 200 has a relatively large area as being commonly provided in the plurality of head chips 110, the cover 200 is provided commonly to the plurality of head chips 110, the grounding is likely to become insufficient only by grounding the cover 200 by one single conduction portion 210, and the cover 200 is likely to work similar to an antenna. In addition, similar to the embodiment, in a case where the plurality of covers 200 are disposed to be aligned in the second direction Y, amplification and directivity occurs in the second direction Y in which the covers 200 are aligned and deteriorates. In the embodiment, by connecting the cover 200 to the ground by the plurality of conduction portions 210, it is possible to sufficiently connect the cover 200 having a relatively large area to the ground, to suppress operation of the cover 200 similar to an antenna, and to suppress the generation of the amplification and directivity by the cover 200 even when the covers 200 are aligned.

In addition, in the embodiment, in the in-plane direction of the nozzle surface 20*a*, that is, in the direction including the first direction X and the second direction Y, the direction in which the plurality of conduction portions 210 which conduct to each of the covers 200 are arranged becomes a direction along the direction in which the plurality of circuit boards 310 that perform grounding of the base 300 are arranged. In other words, in the embodiment, the two conduction portions 210 which conduct to one cover 200 are arranged along the fourth direction Xa, and the two circuit boards 310 are disposed to be arranged in the first direction X. Therefore, the distance between each of the conduction portion 210 and the circuit board 310 becomes short, and the conduction portion 210 can be effectively grounded. In addition, a case where the direction in which the plurality of conduction portions 210 are arranged is along the direction in which the circuit boards 310 are arranged, includes not only a case where the direction in which the conduction portions 210 are arranged and the circuit boards 310 are arranged are the same as each other but also a case where the direction in which the circuit boards 310 are arranged has a component (vector) directed to the direction in which the conduction portions 210 are arranged. In other words, a case where the direction in which the conduction portions 210 are arranged with respect to the direction in which the circuit boards 310 are arranged is less than 90 degrees. In this manner, when the direction in which the conduction portions 210 are arranged with respect to the direction in which the circuit boards 310 are arranged is less than 90 degrees, the distance between each of the conduction portion 210 and the circuit board 310 becomes short and it is possible to effectively ground the conduction portion 210.

In addition, in the embodiment, by conducting the grounded circuit board 310 and the base 300 to each other via the control cable 7*a*, and by grounding the base 300 and conducting the base 300 and the conduction portion 210, the conduction portion 210 is grounded, but not being limited thereto, for example, the conduction portion 210 may be grounded without conducting to the base 300, or the base 300 may be directly grounded without conducting to the circuit board 310. In any case, the cover 200 may be grounded by the plurality of conduction portions 210. Incidentally, in a case where the conduction portion 210 is grounded not via the base 300, it is not necessary for the base 300 to be made of a material having conductivity.

In addition, in the present embodiment, in the sectional direction illustrated in FIG. 8, the cover 200 which forms the outer circumference of the recording head 3, the conduction portion 210, the base 300, and the base cover 500 are conducted and grounded. In other words, the recording head 3 is surrounded by a member which is continuously conducted across the circumferential direction that surrounds at least one of the piezoelectric actuator 13 which is the pressure generating element and the driving circuit 112 which has the switching element in the direction including the first direction X and the third direction Z. Therefore, the piezoelectric actuator 13 which is the pressure generating element and the driving circuit 112 which has the switching element on the inside of the recording head 3 surrounded by the conducted and grounded member, that is, the cover 200, the conduction portion 210, the base 300, and the base cover 500, can suppress influence of noise from the outside, and the noise generated from the piezoelectric actuator 13 and the driving circuit 112 can be suppressed from being emitted to the outside.

In addition, in the embodiment, in the recording head 3, the cover 200, the conduction portion 210, the base 300, and the base cover 500 which form the outer circumference in the direction including the first direction X and the third direction Z, are grounded while conducting to each other across the circumferential direction, but in the second direction Y, an enclosure by the plate-like member may be continuous. In other words, since the conduction portion 210 of the embodiment is provided for each cover 200, the enclosure by plate-like members is not continuous between the conduction portions 210 arranged in parallel in the second direction Y. In other words, since the conduction portions 210 arranged in parallel in the second direction Y. In this manner, even when the enclosure made by plate-like members between the conduction portions 210 is not continuous, it is possible to suppress influence of noise from the outside on the pressure generating element or the switching element, and the noise from the inside of the recording head 3 is unlikely to be radiated to the outside. In addition, in a case where the interval between the conduction portions 210 arranged in parallel in the second direction Y is wide and the inside is influenced by noise and noise is radiated to the outside, by increasing the number of conduction portions 210 arranged in parallel in the second direction Y, the interval may be narrow.

In addition, in the embodiment, the conduction portion 210 is provided on both sides of the cover 200 in the first direction X so as to be in contact with the center portion of the cover 200 in the second direction Y, but not being limited thereto, for example, the conduction portion 210 may be provided so as to be in contact with both of the end portions of the second extending portion 203 in the second direction Y. In other words, in a plan view from the third direction Z with respect to one cover 200, the total of four conduction portions 210 may be provided at positions that correspond to each of four corner portions of the base portion 201. Accordingly, it is possible to more reliably suppress the function of the cover 200 as an antenna.

In addition, in the embodiment, the foot portions 128 are provided on both sides of the holding member 120 in the first direction X, however, the foot portion 128 may not be provided.

Figure 9:
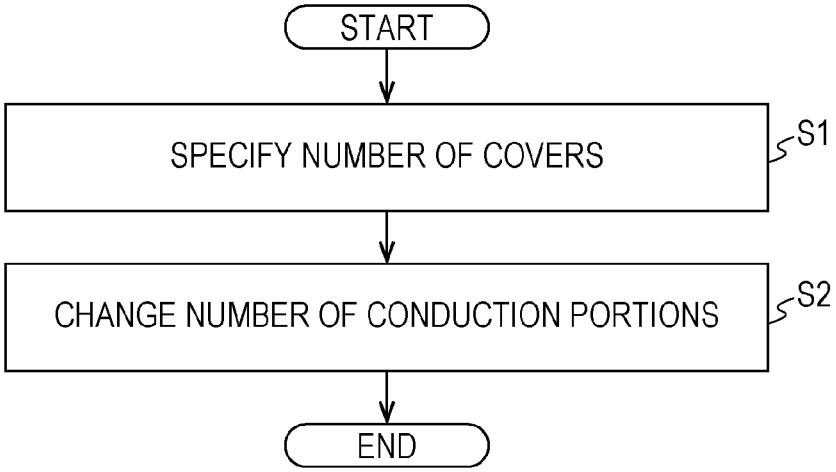
FIG. 9 is a flowchart illustrating a manufacturing method of the recording head according to the Embodiment 1.

Here, a manufacturing method of the ink jet recording head of the embodiment will be described. FIG. 9 is a flowchart illustrating the manufacturing method of the ink jet recording head of the embodiment.

First, as illustrated in FIG. 9, in step S1, the number of covers 200 provided in the base 300 is specified (number specifying step). In the embodiment, since six head main bodies 100 are provided for one base 300 and one cover 200 is provided for each of the head main bodies 100, the number of the covers 200 is specified as six.

Next, in step S2, based on the number of the covers 200 specified in step S1, the number of conduction portions 210 for conducting the base 300 and the cover 200 to each other changes. In the embodiment, since two conduction portions 210 are provided for one cover 200, the number of conduction portions 210 changes to twelve in total for six covers 200. By specifying the number of covers 200 provided in the base 300 and changing the number of necessary conduction portions 210 based on the specified number of the covers 200 in this manner, the number of conduction portions 210 necessary for the recording head 3 to be manufactured can be easily. In other words, according to the manufacturing method of the embodiment, in a case where the number of the covers 200 provided in the base 300 increases, the number of the conduction portions 210 can be increased, and in a case where the number of the covers 200 provided in the base 300 is small, the number of conduction portions 210 can be reduced. Accordingly, it possible to select the optimum number of conduction portions 210 based on the number of covers 200 provided in the base 300.

After specifying the number of the covers 200 and changing the number of the conduction portions 210 in this manner, the head main body 100 and the cover 200 are fixed to the base 300 and the recording head 3 is manufactured by providing the conduction portion 210.

In addition, in step S2, the number of conduction portions 210 is changed to be greater than the number of covers 200. Accordingly, the number of the conduction portions 210 for grounding the cover 200 is increased, and thus, the ground failure of the cover 200 can be suppressed.

As described above, the recording head 3 according to the embodiment includes: the conductive base 300; the plurality of head main bodies 100 which are held by the base 300 and has the driving circuit 112 having a switching element and the piezoelectric actuator 13 which is the pressure generating element for discharging the liquid in the pressure generating chamber 12; the plurality of covers 200 which are conductive covers separated from the base 300 and sandwich at least one of the piezoelectric actuator 13 that is the pressure generating element and the driving circuit 112 that is the switching element between the base 300 and the cover 200; and the plurality of conduction portions 210 which conduct the base 300 and the cover 200 to each other at a plurality of locations.

In this manner, by conducting the cover 200 which sandwiches the driving circuit 112 or the piezoelectric actuator 13 with the base 300 to the base 300 by the plurality of conduction portions 210, the cover 200 can be grounded in a plurality of conduction portions 210. Therefore, the cover 200 functions as an antenna, and it is possible to suppress the noise from the inside of the recording head 3 from being emitted to the outside by the cover 200. In addition, since the cover 200 and the base 300 are conducted and grounded in the conduction portion 210, a gap between the cover 200 and the base 300 acts as an antenna, and it is possible to suppress the noise from the inside of the recording head 3 from being emitted to the outside by the cover 200. Furthermore, since the cover 200 and the base 300 are conducted and grounded in the conduction portion 210, at least one of the piezoelectric actuator 13 and the driving circuit 112 sandwiched between the cover 200 and the base 300 can be protected from external noise. Therefore, malfunction of the piezoelectric actuator 13 or the driving circuit 112 can be suppressed.

In the embodiment, since both of the piezoelectric actuator 13 and the driving circuit 112 are sandwiched between the cover 200 and the base 300, both of the piezoelectric actuator 13 and the driving circuit 112 can be protected from external noise, but not being particularly limited thereto, for example, only one of the piezoelectric actuator 13 and the driving circuit 112 may be sandwiched between the cover 200 and the base 300. It is possible to reliably protect any one of the piezoelectric actuator 13 and the driving circuit 112 sandwiched between the cover 200 and the base 300 from external noise.

In addition, in the embodiment, it is preferable that the plurality of head main bodies 100 be arranged in the direction including the first direction X and the second direction Y that are the in-plane directions of the nozzle surface 20*a* which ejects the ink that is a liquid of the head main body 100, the plurality of conduction portions 210 be arranged in the direction including the first direction X and the second direction Y that are in-plane directions of the nozzle surface 20*a* which ejects the ink that is a liquid of the head main body 100, and the second direction Y in which the plurality of the head main bodies 100 are arranged and the fourth direction Xa in which the plurality of the conduction portions 210 are arranged intersect with each other.

By intersecting the second direction Y which is the direction in which the plurality of head main bodies 100 are arranged and the fourth direction Xa which is the direction in which the plurality of conduction portions 210 are arranged, the plurality of head main bodies 100 can be arranged at a high density, and it is possible to provide the plurality of conduction portions 210 for one head main body 100.

In addition, the direction in which the plurality of head main bodies 100 are arranged and the direction in which the plurality of conduction portions 210 are arranged may be the same direction. However, since the conduction portion 210 is disposed between the two head main bodies 100, compared to a case where the direction in which the plurality of head main bodies 100 are arranged and the direction in which the plurality of conduction portions 210 are arranged intersect each other similar to the embodiment, the distance between the two head main bodies 100 is likely to be wide, and there is a concern that the density deteriorates.

In addition, in the embodiment, in the direction including the first direction X and the second direction Y that are in-plane directions of the nozzle surface 20*a* which ejects the ink that is a liquid of the head main body 100, the plurality of conduction portions 210 are at a position of sandwiching at least one of the piezoelectric actuator 13 which is the pressure generating element and the driving circuit 112 having the switching element, and, in the third direction Z which is the direction orthogonal to the in-plane direction of the nozzle surface 20*a* which ejects the ink that is a liquid of the head main body 100, the plurality of conduction portions 210 are positioned on the same side with respect to the cover 200. In this manner, by providing the plurality of conduction portions 210 at the position at the position of sandwiching the piezoelectric actuator 13 or the driving circuit 112 in the direction including the first direction X and the second direction Y which are the in-plane directions of the nozzle surface 20*a* which eject the ink which is a liquid of the head main body 100, in the sectional direction illustrated in FIG. 8, it is possible to link, conduct, and ground the base 300, the cover 200, and the conduction portion 210 so as to surround the periphery of the piezoelectric actuator 13 or the driving circuit 112. Therefore, noise generated from the piezoelectric actuator 13 or the driving circuit 112 can be suppressed from being emitted to the outside, and the influence of noise from the outside of the piezoelectric actuator 13 or the driving circuit 112 can be suppressed.

In the embodiment, both of the actuator 13 and the driving circuit 112 are sandwiched between the cover 200 and the base 300 in the third direction Z which is the direction orthogonal to the in-plane direction of the nozzle surface 20*a* which ejects the ink that is the liquid of the head main body 100, and both of the piezoelectric actuator 13 and the driving circuit 112 are sandwiched between the plurality of conduction portions 210 in the direction including the first direction X and the second direction Y which are the in-plane directions of the nozzle surface 20*a* which ejects the ink that is the liquid of the head main body 100. Therefore, noise generated from both of the piezoelectric actuator 13 and the driving circuit 112 can be suppressed, and both of the piezoelectric actuator 13 and the driving circuit 112 can be protected from external noise. Not being limited thereto, it is needless to say that only one of the piezoelectric actuator 13 and the driving circuit 112 may be sandwiched between the plurality of conduction portions 210.

In addition, in the third direction Z which is a direction orthogonal to the in-plane direction of the nozzle surface 20*a* which ejects the ink that is the liquid of the head main body 100, the plurality of conduction portions 210 are positioned on the same side with respect to the cover 200. In other words, in the embodiment, in the third direction Z, the plurality of conduction portions 210 are positioned on the base 300 side with respect to the cover 200. Accordingly, it is possible to suppress unbalance of the stress with which the plurality of conduction portions 210 abut against the cover 200, and to suppress displacement of the cover 200 and the head main body 100.

In addition, in the embodiment, the plurality of conduction portions 210 are positioned on the base 300 side with respect to the cover 200 in the third direction Z, but not being limited thereto, in the third direction Z, the plurality of conduction portions 210 may be positioned on the side opposite to the base 300 with respect to the cover 200, that is, on the side of the recording sheet S which is an ejection target medium. However, when the plurality of conduction portions 210 are positioned closer to the recording sheet S than the cover 200, a space for disposing the conduction portion 210 is required between the recording head 3 and the recording sheet S, and thus, similar to the embodiment, by providing the plurality of conduction portions 210 in the third direction Z so as to be positioned on the base 300 side with respect to the cover 200, it is possible to shorten the distance between the recording head 3 and the recording sheet S in the third direction Z, and it is possible to suppress displacement of landing positions of ink droplets discharged from the recording head 3 on the recording sheet S.

It is needless to say that, in the third direction Z, the plurality of conduction portions 210 may be disposed on different sides with respect to from the cover 200.

In addition, in the embodiment, the cover 200 has a liquid repellent surface 205, and the conduction portion 210 is in contact with the cover 200 on a surface opposite to the liquid repellent surface 205 of the cover 200. Accordingly, the cover 200 and the conduction portion 210 can be reliably conducted.

In addition, in the embodiment, the plurality of circuit boards 310 which are connected to the head main body 100 and are for grounding the cover 200, is provided, the plurality of conduction portions 210 are arranged in the in-plane direction of the nozzle surface 20*a* which ejects the ink of the head main body 100, the plurality of circuit boards 310 are arranged in the in-plane direction of the nozzle surface 20*a* which ejects the ink that is a liquid of the head main body 100, and the direction in which the plurality of conduction portions 210 are arranged and the direction in which the plurality of circuit boards 310 are arranged are along each other. Accordingly, the distance between each of the conduction portions 210 and the circuit board 310 becomes short, and the conduction portion 210 can be effectively grounded.

In addition, in the embodiment, the direction in which the plurality of conduction portions 210 are arranged and the direction in which the plurality of circuit boards 310 are arranged are set to be directions along each other, but not being particularly limited thereto, the direction in which the plurality of conduction portions 210 are arranged and the direction in which the plurality of circuit boards 310 are arranged may be directions intersect with each other.

In addition, in the embodiment, it is preferable that the head main body 100 include the plurality of head chips 110 having a flow path of the ink to be discharged from the nozzle surface 20*a* of the head main body 100. According to this, by arranging the plurality of head chips 110 for one head main body 100 in multiple rows of nozzle rows, it is possible to dispose the nozzle openings 21 with high density, and it is possible to improve the yield compared to a case where a plurality of nozzle rows are provided only in one head chip 110 for one head main body 100 to form multiple rows. It is needless to say that the head main body 100 may have one head chip 110.

Embodiment 2

Figure 10:
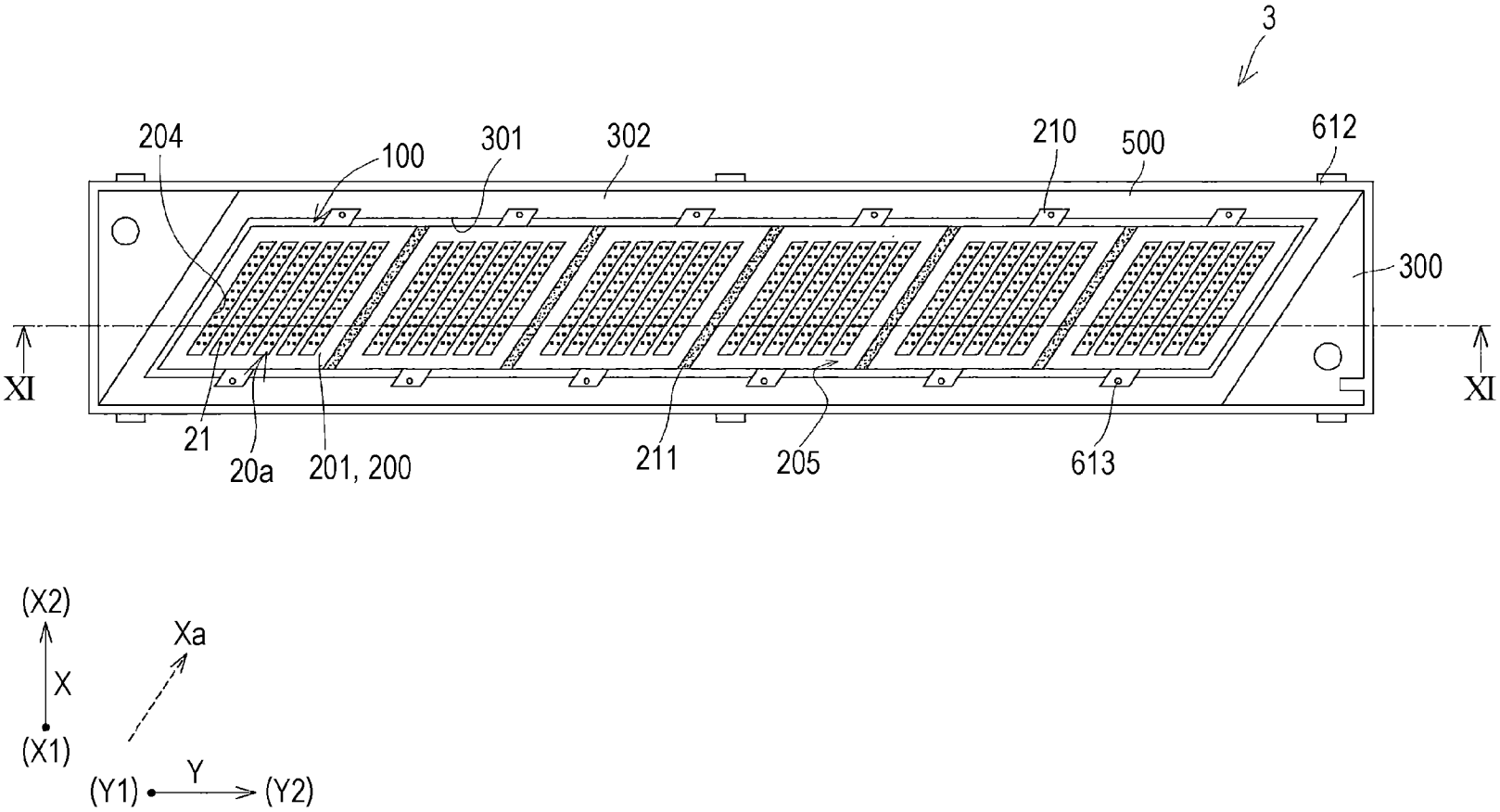
FIG. 10 is a plan view of a recording head according to Embodiment 2.
Figure 11:
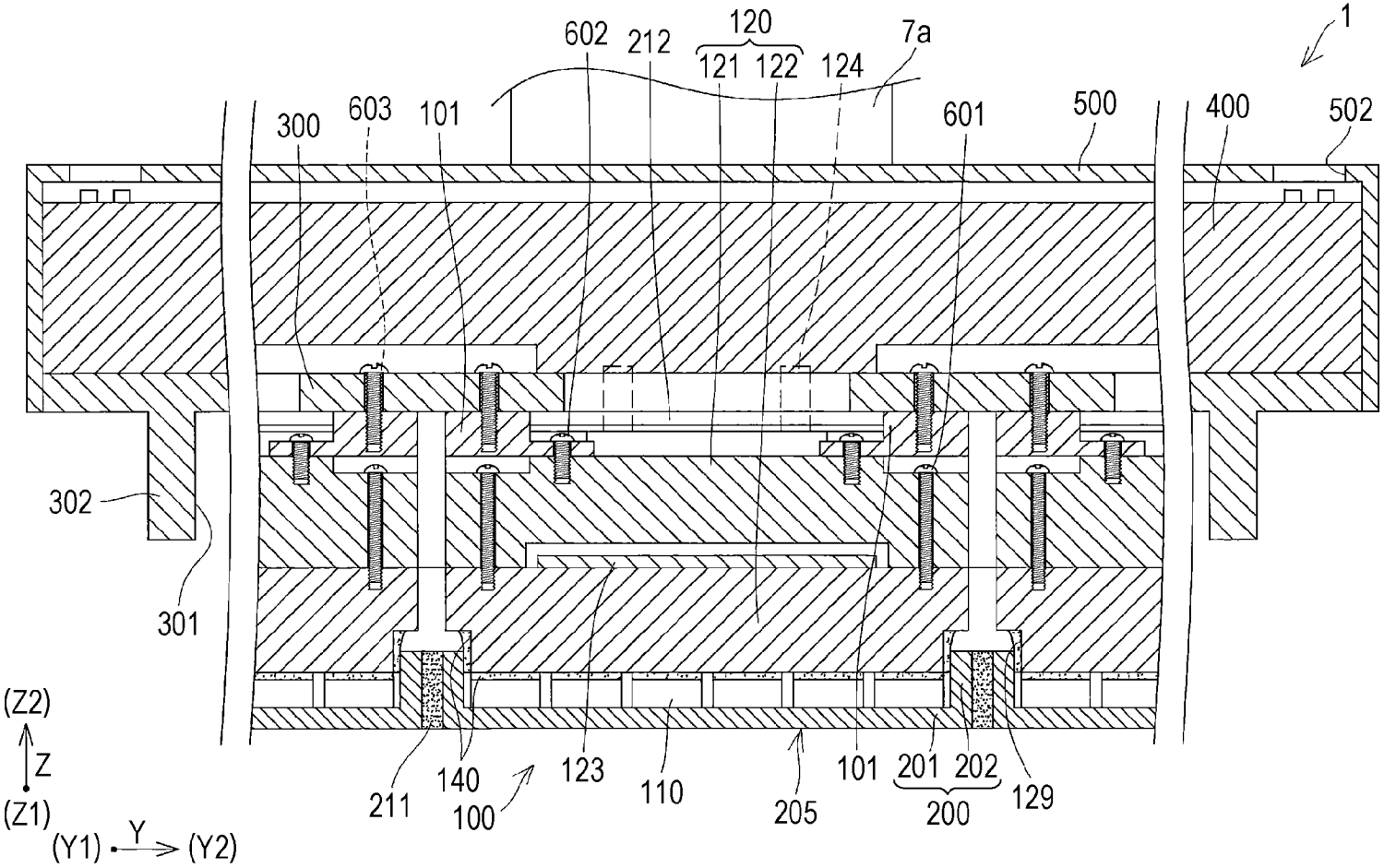
FIG. 11 is a sectional view of main portions of a recording head according to Embodiment 2.

FIG. 10 is a plan view from the liquid ejecting surface side of the recording head according to Embodiment 2 of the invention, and FIG. 11 is a sectional view of main portions taken along line XI-XI of FIG. 10. In addition, the same reference numerals will be given to the same members as those in the above-described embodiment, and overlapping description will be omitted.

As illustrated in FIGS. 10 and 11, the recording head 3 includes: a plurality of conduction portions 210 for conducting the cover 200 and the base 300 to each other; and a gap conduction portion 211 having conductivity provided between the covers 200 adjacent to each other in the second direction Y and conducts the covers 200 to each other. In other words, the conduction portion includes the gap conduction portion 211 which conducts the covers 200 adjacent to each other among the plurality of covers 200.

The gap conduction portion 211 is provided so as to close the gaps of the covers 200 adjacent to each other in the second direction Y. In other words, the gap conduction portion 211 is provided so as to close the openings on the Z1 side in the gaps of the covers 200 adjacent to each other in the second direction Y. In this manner, by closing the gaps between the adjacent covers 200 with the gap conduction portion 211, it is possible to prevent ink from entering the gaps between the covers 200 adjacent to each other. In addition, it is preferable that the gap conduction portion 211 be provided so as to close the opening on the side surface in the first direction X in the gap of the cover 200. Accordingly, it is also possible to suppress the entering of ink from the opening on the side surface in the first direction X. It is needless to say that the gap conduction portion 211 is not limited to one that closes all the openings on the Z1 side of the covers 200 that are adjacent to each other, and for example, the gap conduction portion may close only a part of the opening on the Z1 side of mutually adjacent covers 200.

It is preferable that the gap conduction portion 211 be attachably and detachably provided to at least one of the covers adjacent to each other. Accordingly, it is possible to easily attach and detach the head main body 100 integrated with the cover 200 from the base 300, and to easily position the relative positions of the nozzle openings 21 of the head main body 100. In addition, a case where the gap conduction portion 211 is attachable and detachable to and from at least one of the covers 200 adjacent to each other means, for example, that the gap conduction portion 211 is fixed to one of the covers 200 adjacent to each other and in an abutting state as a pressure is applied by being biased to the other one of the covers 200. In addition, a state where the gap conduction portion 211 is fixed to at least one of the mutually adjacent covers 200 with screws or the like, is also included. In other words, the cover 200 may have a configuration in which easy attachment and detachment to and from at least one of the covers 200 are possible. It is needless to say that the gap conduction portion 211 may be attachably and detachably provided in both of the covers 200 adjacent to each other. As such a configuration, for example, a case where the gap conduction portion 211 is fixed to the base 300 and is in an abutting state by being biased to both of the covers 200 adjacent to each other, is employed.

As such a gap conduction portion 211, it is appropriate to use a porous metal material, such as metal fiber or foamed metal. By using a porous metal material as the gap conduction portion 211 as described above, it is possible to easily attach and detach to and from at least one of the covers 200 adjacent to each other. In other words, since the gap conduction portion 211 made of a porous metal material can be held in the gaps of the covers 200 adjacent to each other by the elastic force, it is also possible to attach and detach the gap conduction portion 211 to and from both of the covers 200 adjacent to each other, and to attach and detach the gap conduction portion 211 to the other one of the covers by fixing the gap conduction portion 211 to one of the covers 200 adjacent to each other.

In addition, by using the gap conduction portion 211 made of a porous metal material, even when the ink adheres to the gap conduction portion 211, the ink is likely to stick to the meniscus, and it is possible to hold the ink in the gaps between the adjacent covers 200 in the second direction Y. Therefore, it is possible to prevent the ink held in the gap of the cover 200 from dropping at an unexpected timing, soiling the recording sheet S.

By providing the gap conduction portion 211 as described above, it is possible to conduct the covers 200 adjacent to each other. Therefore, it is possible to suppress grounding failure by increasing the number of conduction portions 210 for grounding one cover 200. In addition, by making the arranged covers 200 conduct to each other, it is possible to further suppress the generation of the amplification and directivity of the cover 200 similar to a loop antenna in the direction in which the covers 200 are arranged.

In addition, in the embodiment, although the porous metal material is exemplified as the gap conduction portion 211, the material of the gap conduction portion 211 is not particularly limited thereto, for example, the gap conduction portion 211 may be a plate spring or a coil spring. In addition, the gap conduction portion 211 may be a conductive wire or the like. Furthermore, the gap conduction portion 211 may be a conductive adhesive, solder, or the like. However, in a case where a conductive adhesive or solder is used as the gap conduction portion 211, since the adjacent covers 200 adhere to each other, it is difficult to attach and detach the head main body 100 provided with the cover 200. In addition, the gap conduction portion 211 may be capable of conducting the covers 200 adjacent to each other in the second direction Y. Therefore, the gap conduction portion 211 may close the gaps of the covers 200 adjacent to each other in the second direction Y, and may not close the gaps between the covers 200 adjacent to each other in the second direction Y. Incidentally, closing the gaps of the covers 200 adjacent to each other in the second direction Y means that the gap conduction portion 211 completely closes the gaps of the covers 200 adjacent to each other in the second direction Y. In addition, a case where the gaps of the covers 200 adjacent to each other in the second direction Y are not closed means a case other than the case where the gap conduction portion 211 completely closes the gaps of the covers 200 adjacent to each other in the second direction Y. In other words, the gap conduction portion 211 does not close the gaps of the covers 200 adjacent to each other in the second direction Y includes a case where the gap conduction portion 211 is provided in the gaps of the covers 200 adjacent to each other in the second direction Y and closes a part of the gap, and a case where the gap conduction portion 211 is disposed in a space other than the gaps between the covers 200 adjacent to each other in the second direction Y so as not to completely close the gaps.

In addition, in the embodiment, the two conduction portions 210 are provided in each of the covers 200, but the invention is not particularly limited thereto, and for example, the conduction portions 210 which conduct the cover 200 on both sides in the second direction Y which is the arrangement direction, may further be added with respect to the covers 200 in both of the end portions in the second direction Y which is the arrangement direction of the arranged covers 200. Accordingly, it is possible to reliably perform the grounding at both of the end portions of the plurality of covers 200 conducted by the gap conduction portion 211 in the arrangement direction.

As described above, in the embodiment, the conduction portion includes the gap conduction portion 211 for conducting the covers 200 adjacent to each other among the plurality of covers 200. By providing the gap conduction portion 211 as described above, it is possible to ground the plurality of covers 200 arranged in parallel to each other, and it is possible to suppress ground failure and to further suppress the occurrence of amplification and directivity of the covers 200 in the arrangement direction of the cover 200 similar to a loop antenna.

In addition, it is preferable that the gap conduction portion 211 be a porous metal. In this manner, by using the porous metal as the gap conduction portion 211, it is possible to hold the ink adhering to the gap conduction portion 211 of the gap between the covers 200 adjacent to each other, and to prevent the ink from falling unexpectedly.

In addition, it is preferable that the gap conduction portion 211 closes the gaps between the covers 200 adjacent to each other. In this manner, by closing the gaps between the adjacent covers 200 with the gap conduction portion 211, it is possible to prevent ink from entering the gaps between the covers 200 adjacent to each other.

In addition, it is preferable that the gap conduction portion 211 be attachably and detachably provided to at least one of the covers 200 adjacent to each other. In this manner, by making the gap conduction portion 211 attachable and detachable to and from at least one of the covers 200 adjacent to each other, it is possible to easily attach and detach the head main body 100 integrated with the cover 200 from the base 300. Therefore, it is possible to easily perform maintenance, such as cleaning that requires exchange or attachment and detachment of the head main body 100. In addition, the gap conduction portion 211 may be attachably and detachably provided on both of the adjacent covers 200. However, compared to a case where the gap conduction portion 211 is attachably and detachably provided in both of the two covers 200, in a case where the gap conduction portion 211 is attachably and detachably provided in one cover 200 among the covers 200 adjacent to each other, the gap conduction portion 211 can suppress of falling down at an unexpected timing by vibration or the like. It is needless to say that the gap conduction portion 211 may be fixed such that it is not possible to easily remove gap conduction portion 211 to both of the covers 200 adjacent to each other.

Other Embodiments

Although the embodiments of the invention have been described above, the basic configuration of the invention is not limited to the above-described one.

For example, in each of the above-described embodiments, the cover 200 is provided on the Z1 side of the head main body 100, but the present invention is not limited thereto, and for example, without providing the cover 200, the nozzle plate 20 having conductivity, such as metal, may be provided. In other words, the nozzle plate 20 having conductivity may practically serve as a cover. In other words, the cover described in the claims may be the cover 200 of the above-described Embodiment 1, or may be the nozzle plate 20 provided in each of the head chips 110.

In addition, in the above-described embodiment, the piezoelectric actuator 13 which is the pressure generating element and the driving circuit 112 having the switching element are disposed between the cover 200 and the base 300, but, the invention is not particularly limited thereto, and at least one of the pressure generating element and the switching element may be positioned between the cover 200 and the base 300. For example, even when the switching element is disposed between the cover 200 and the base 300 and the pressure generating element is disposed on the side of the cover 200 opposite to the base 300, it is possible to suppress the noise from the switching element provided between the cover 200 and the base from being emitted to the outside, and to suppress malfunction of the switching element due to the influence of external noise.

In addition, in each of the above-described embodiments, the arrangement direction of the plurality of head main bodies 100 held by the base 300 is defined as the second direction Y which is a direction perpendicular to the first direction X that is the transport direction of the recording sheet S, but the invention is not limited thereto, and the recording head in which the head main bodies 100 are arranged in the longitudinal direction of the base 300 may be disposed such that the direction in which the plurality of head main bodies 100 are aligned achieves an angle intersecting with the first direction X that is the transport direction of the recording sheet S, that is, an angle which is smaller than that in the first direction X by 90 degrees. At this time, in the in-plane direction of the nozzle surface 20*a*, even when the nozzle rows are provided in the direction perpendicular to the longitudinal direction of the base 300, by inclining the entire recording head, it is possible to dispose the nozzle rows inclined in the first direction X which is the transport direction.

In addition, in each of the above-described embodiments, a plurality of head main bodies 100 are provided in one recording head 3, but the invention is not particularly limited thereto, and one head main body 100 may be provided for one recording head 3.

In addition, in each of the above-described embodiments, disposition in which the fourth direction Xa which is the arrangement direction of the nozzle openings 21 of the head chip 110 is a direction inclined with respect to the second direction Y perpendicular to the first direction X that is the transport direction, is employed, but the fourth direction Xa which is the arrangement direction of the nozzle openings 21 may be the same direction as the first direction X which is the transport direction, or the fourth direction Xa which is the arrangement direction of the nozzle openings 21 may be the same direction as the second direction Y. Furthermore, the nozzle openings 21 are not limited to those provided in a row, and the nozzle openings 21 may be disposed in a matrix. Furthermore, in the above-described Embodiment 1, the holding member 120 is formed into a substantial parallelogram shape when viewed in a plan view from the third direction Z perpendicular to the nozzle surface 20*a*, but the invention is not limited thereto, and the shape may be rectangular shape, a trapezoidal shape, or a polygonal shape.

Furthermore, in the above-described Embodiment 1, a so-called line type recording apparatus is described as the ink jet type recording apparatus 1 in which the recording head 3 is fixed to the apparatus main body 2 and the printing is performed only by transporting the recording sheet S, but the invention is not limited thereto, and can be employed in a so-called serial type recording apparatus that performs printing while moving the recording head 3 in a direction intersecting with the first direction X that is the transport direction of the recording sheet S, for example, while moving the recording head 3 in a direction intersecting with the transport direction after loading the recording head 3 onto a carriage that moves in the second direction Y. In addition, the configuration is not limited to the configuration in which the recording sheet S is transported to the recording head 3, and printing may be performed by the configuration in which the recording head 3 is moved with respect to the recording sheet S, or the recording sheet S may be relatively transported to the recording head 3.

Furthermore, the invention is broadly applicable to liquid ejecting heads in general, and examples thereof include recording heads, such as various types of ink jet type recording heads used in image recording apparatus, such as printers, a color material ejecting head used for manufacturing a color filter, such as a liquid crystal display, an electrode material ejecting head used for forming electrodes, such as an organic EL display or an field emission display (FED), and a bioorganic material ejecting head used for manufacturing a bio chip.

CROSS-REFERENCE TO RELATED APPLICATIONS

This application claims priority to Japanese Patent Application No. 2017-079504 filed on Apr. 13, 2017 and Japanese Patent Application No. 2018-010292 filed on Jan. 25, 2018. The entire disclosure of Japanese Patent Application No. 2017-079504 filed on Apr. 13, 2017 and Japanese Patent Application No. 2018-010292 filed on Jan. 25, 2018 are expressly incorporated by reference herein.

What is claimed is:

1. A liquid ejecting head comprising:

a conductive base;

a plurality of head main bodies which are held by the base and each have a switching element and a pressure generating element for discharging a liquid in a pressure generating chamber;

a plurality of covers which are conductive covers separated from the base, both of the pressure generating element and the switching element being sandwiched between the base and each of the covers; and a plurality of conduction portions which each conduct the base and the cover to each other at a plurality of locations.

2. A liquid ejecting apparatus comprising:

the liquid ejecting head according to claim 1.

3. The liquid ejecting head according to claim 1, wherein the plurality of head main bodies are arranged in an in-plane direction of a nozzle surface which ejects a liquid of the head main body, wherein the plurality of conduction portions are arranged in the in-plane direction of the nozzle surface which ejects the liquid of the head main body, and wherein a direction in which the plurality of head main bodies are arranged and a direction in which the plurality of conduction portions are arranged intersect with each other.

4. A liquid ejecting apparatus comprising:

the liquid ejecting head according to claim 3.

5. The liquid ejecting head according to claim 1, wherein, in the in-plane direction of the nozzle surface which ejects the liquid of the head main body, each of the plurality of conduction portions is at a position of sandwiching at least one of the pressure generating element and the switching element, and wherein, in the direction orthogonal to the in-plane direction of the nozzle surface which ejects the liquid of the head main body, the plurality of conduction portions are positioned on the same side with respect to the cover.

6. A liquid ejecting apparatus comprising:

the liquid ejecting head according to claim 5.

7. The liquid ejecting head according to claim 5, wherein the cover has a liquid repellent surface, and wherein the conduction portion is in contact with the cover on a surface opposite to the liquid repellent surface of the cover.

8. A liquid ejecting apparatus comprising:

the liquid ejecting head according to claim 7.

9. The liquid ejecting head according to claim 1, comprising:

a plurality of circuit boards which are each connected to the head main body and are for each grounding the cover, wherein the plurality of conduction portions are arranged in the in-plane direction of the nozzle surface which ejects the liquid of the head main body, wherein a plurality of the circuit boards are arranged in the in-plane direction of the nozzle surface which ejects the liquid of the head main body, and wherein the direction in which the plurality of conduction portions are arranged and the direction in which the plurality of circuit boards are arranged are along each other.

10. The liquid ejecting head according to claim 1, wherein each of the conduction portions include a gap conduction portion which conducts the covers adjacent to each other among the plurality of covers.

11. The liquid ejecting head according to claim 10, wherein the gap conduction portion is a porous metal.

12. The liquid ejecting head according to claim 10, wherein the gap conduction portion blocks a gap between the covers adjacent to each other.

13. The liquid ejecting head according to claim 10, wherein the gap conduction portion is provided to be attachable and detachable to and from at least one of the covers adjacent to each other.

14. The liquid ejecting head according to claim 1, wherein the head main body includes a plurality of head chips each having a flow path of the liquid to be discharged from the nozzle surface of the head main body.

15. A manufacturing method of a liquid ejecting head including a plurality of head main bodies which each discharge a liquid in a pressure generating chamber by a switching element and a pressure generating element, a plurality of conductive covers, and a base, the method comprising:

specifying the number of the covers provided in the base;

changing the number of conduction portions to be provided which each conduct the base and each of the covers to each other based on the number of the covers specified in the specification; and providing the conduction portions to the base by fixing each of the plurality of head main bodies and each of the plurality of covers so that both of the pressure generating element and the switching element are sandwiched between the base and each of the covers.

16. The manufacturing method of a liquid ejecting head according to claim 15, wherein the number of the conduction portions is greater than the number of the covers.

17. A liquid ejecting head comprising:

a conductive base;

a plurality of head main bodies, each of which is held by the base and has a corresponding switching element and a corresponding pressure generating element for discharging a liquid in the pressure generating chamber;

a plurality of covers which are conductive covers separated from the base, each of the switching elements being sandwiched between the base and a corresponding cover of the plurality of covers; and a plurality of conduction portions, each of which electrically connects the base and a corresponding cover of the plurality of covers at a different location.

18. The liquid ejecting head according to claim 17, wherein the plurality of head main bodies are arranged in an in-plane direction of a nozzle surface, from which a liquid is ejected out of at least one of the plurality of head main bodies, wherein the plurality of conduction portions are arranged in the in-plane direction of the nozzle surface, from which the liquid is ejected out of the at least one of the head main bodies, and wherein a direction in which the plurality of head main bodies are arranged and a direction in which the plurality of conduction portions are arranged intersect each other.

19. The liquid ejecting head according to claim 17, wherein, in the in-plane direction of the nozzle surface, from which the liquid is ejected out of at least one of the head main bodies, each of the plurality of conduction portions is at a position of sandwiching at least one of the pressure generating elements and at least one of the switching elements, and wherein, in the direction orthogonal to the in-plane direction of the nozzle surface, from which the liquid is ejected out of the at least one of the head main bodies, the plurality of conduction portions are positioned on the same side with respect to the cover.

20. A liquid ejecting apparatus comprising:

the liquid ejecting head according to claim 17.

* * * * *